US006755758B2

(12) United States Patent
Liechty, II

(10) Patent No.: US 6,755,758 B2
(45) Date of Patent: Jun. 29, 2004

(54) INDEPENDENT BLADE RETENTION FOR BLADE-OPENING ARROWHEADS

(76) Inventor: Victor Jay Liechty, II, 1250 N. 1750 W., Provo, UT (US) 84604

( * ) Notice: Subject to any disclaimer, the term of this patent is extended or adjusted under 35 U.S.C. 154(b) by 0 days.

(21) Appl. No.: 09/755,995

(22) Filed: Jan. 6, 2001

(65) Prior Publication Data

US 2001/0006916 A1 Jul. 5, 2001

Related U.S. Application Data

(62) Division of application No. 08/858,096, filed on May 17, 1997, now Pat. No. 6,171,206.

(51) Int. Cl.[7] ..... F42B 6/08
(52) U.S. Cl. ..... 473/583; 473/583
(58) Field of Search ..... 473/582, 583

(56) References Cited

U.S. PATENT DOCUMENTS

| | | | | |
|---|---|---|---|---|
| 1,604,713 A | | 10/1926 | Norlund | |
| 2,289,284 A | | 7/1942 | Chandler | |
| 2,568,417 A | | 9/1951 | Steinbacher | |
| 2,620,190 A | | 12/1952 | Bean | |
| 2,820,634 A | | 1/1958 | Vance | |
| 2,939,708 A | | 6/1960 | Scheib | |
| 2,993,697 A | | 7/1961 | Urban | |
| 3,000,635 A | | 9/1961 | Nieman | |
| 3,014,305 A | | 12/1961 | Yurchich | |
| 3,022,077 A | | 2/1962 | Doonan | |
| 3,036,395 A | | 5/1962 | Nelson | |
| 3,036,396 A | | 5/1962 | Swails | |
| 3,064,977 A | | 11/1962 | Zwickey | |
| 3,138,383 A | | 6/1964 | McKenzie | |
| 3,168,313 A | | 2/1965 | Lint | |
| 3,241,836 A | | 3/1966 | Zwickey | |
| 3,578,328 A | | 5/1971 | Rickey | |
| 3,600,835 A | | 8/1971 | Hendricks | |
| 3,738,657 A | | 6/1973 | Cox | |
| 3,759,519 A | | 9/1973 | Palma | |
| 4,099,720 A | | 7/1978 | Zeren | |
| 4,166,619 A | | 9/1979 | Bergmann et al. | |
| 4,452,460 A | * | 6/1984 | Adams | 473/584 |
| 4,504,063 A | | 3/1985 | Le Bus | |
| D279,813 S | | 7/1985 | Palizzolo | |
| 4,565,377 A | | 1/1986 | Troncoso et al. | |
| 4,579,348 A | | 4/1986 | Jones | |
| 4,615,529 A | | 10/1986 | Vocal | |
| 4,729,320 A | | 3/1988 | Whitten | |
| 4,807,382 A | | 2/1989 | Albrecht | 43/6 |

(List continued on next page.)

OTHER PUBLICATIONS

Packaging: "Mini–Max 3", Mar–Den Inc. Wilcox, AZ.
Packaging: "JackHammer–SST" WASP Archery Products Inc. Plymouth, CT.
Advertisement: Rocket Aeroheads—Steelhead 125 Bow Masters Nov. 1998 p. 23.
Advertisement: Kolpin Modular I & III Broadhead System as in ABCC"ad book" 4th Ed. Apr. 1, 1995, p. K–2.

(List continued on next page.)

*Primary Examiner*—John A. Ricci

(57) ABSTRACT

Blade-opening arrowheads having pivotal blades, wherein each blade is hingedly connected at one blade end to an arrowhead body by a hinge pin. Each blade freely rotates in a plane from a retracted in-flight position to an open position when penetrating an object where the other opposing blade end rotates away from the arrowhead body such that the sharp cutting edges of the blades are exposed at a full cutting diameter when the blades are in the open position. When in the retracted position a blade is securely held selectively adjacent to the arrowhead body by frictional engagement from methods independent of, or not dependent upon, the use of an element or elements in addition to that individual cutting blade, its hinge pin and its blade slot.

27 Claims, 21 Drawing Sheets

U.S. PATENT DOCUMENTS

| | | | | | |
|---|---|---|---|---|---|
| 4,932,671 | A | | 6/1990 | Anderson | |
| 4,940,246 | A | | 7/1990 | Stagg | |
| 4,973,060 | A | | 11/1990 | Herzing | |
| 4,976,443 | A | | 12/1990 | DeLucia | |
| 4,988,112 | A | | 1/1991 | Anderson et al. | |
| 4,998,738 | A | | 3/1991 | Puckett | |
| 5,044,640 | A | | 9/1991 | Del Monte et al. | |
| 5,046,744 | A | | 9/1991 | Eddy | |
| 5,066,021 | A | | 11/1991 | DeLucia | |
| 5,078,407 | A | | 1/1992 | Carlston et al. | |
| 5,082,292 | A | | 1/1992 | Puckett et al. | |
| 5,083,798 | A | | 1/1992 | Massey | |
| 5,090,709 | A | | 2/1992 | Johnson | |
| 5,100,143 | A | | 3/1992 | Puckett | |
| 5,102,147 | A | | 4/1992 | Szeluga | |
| 5,112,063 | A | | 5/1992 | Puckett | |
| 5,172,916 | A | | 12/1992 | Puckett | |
| 5,178,398 | A | | 1/1993 | Eddy | |
| 5,286,035 | A | | 2/1994 | Ward | |
| 5,322,297 | A | | 6/1994 | Smith | |
| 5,458,341 | A | | 10/1995 | Forrest et al. | |
| 5,472,213 | A | | 12/1995 | Dudley | |
| 5,496,042 | A | | 3/1996 | Craft et al. | |
| 5,564,713 | A | * | 10/1996 | Mizek et al. | 473/583 |
| 5,803,844 | A | | 9/1998 | Anderson | |
| 5,803,845 | A | | 9/1998 | Anderson | |
| 5,820,498 | A | | 10/1998 | Maleski | |
| 5,857,930 | A | * | 1/1999 | Troncoso | 473/583 |
| 5,879,252 | A | * | 3/1999 | Johnson | 473/583 |

OTHER PUBLICATIONS

Advertisement: Ex–Calibre–45 & Ex–Calibre 50 as in ABCC "ad book" 4th Ed. Apr. 1, 1995 p. E–3.

Advertisement: Catclaw 4 & Catclaw 6 as in ABCC "ad book" 4th Ed. Apr. 1, 1995 p. C–5.

Advertisement: Browning Serpentine Hunting Point as in ABCC "ad book" 4th Ed Apr. 1, 1995 p. B–30.

Advertisement: Hunting Innovations—Borehead Broadhead as in ABCC "ad book" 4th Ed. Apr. 1, 1995 p. B–7.

Advertisement: KnifeWing Arrowheads—KnifeWing II as in ABCC "ad book" 4th Ed. Apr. 1, 1995 p. K–2.

* cited by examiner

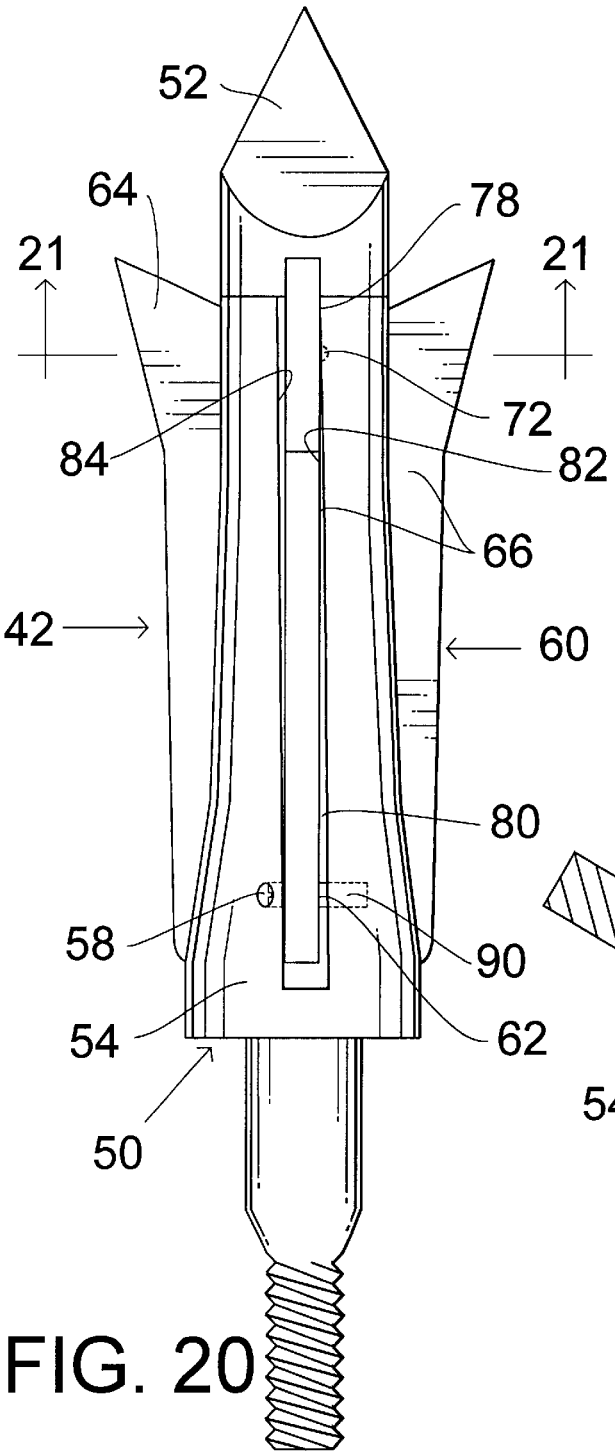
FIG. 20
FIG. 22
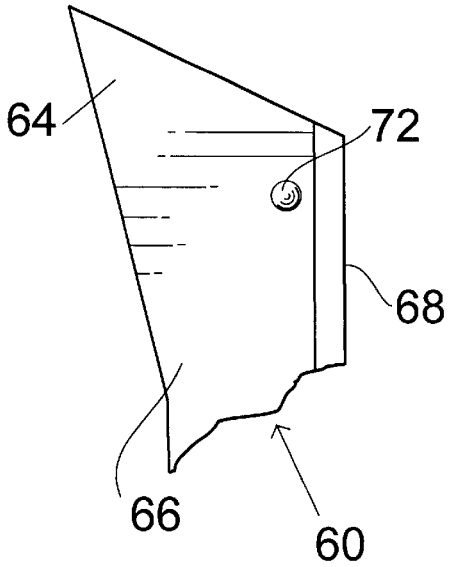
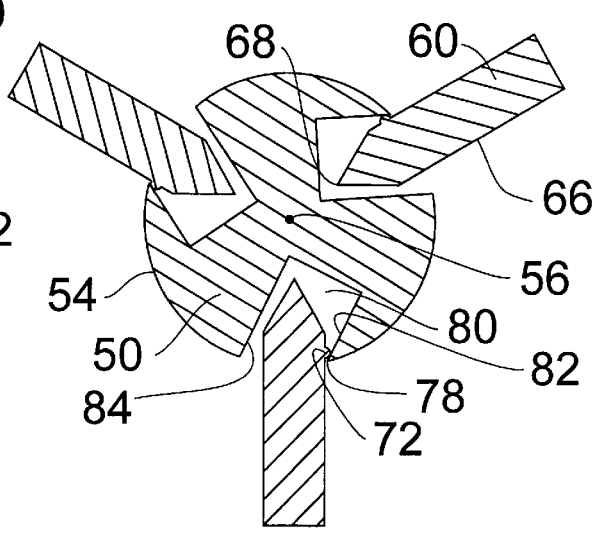
FIG. 21

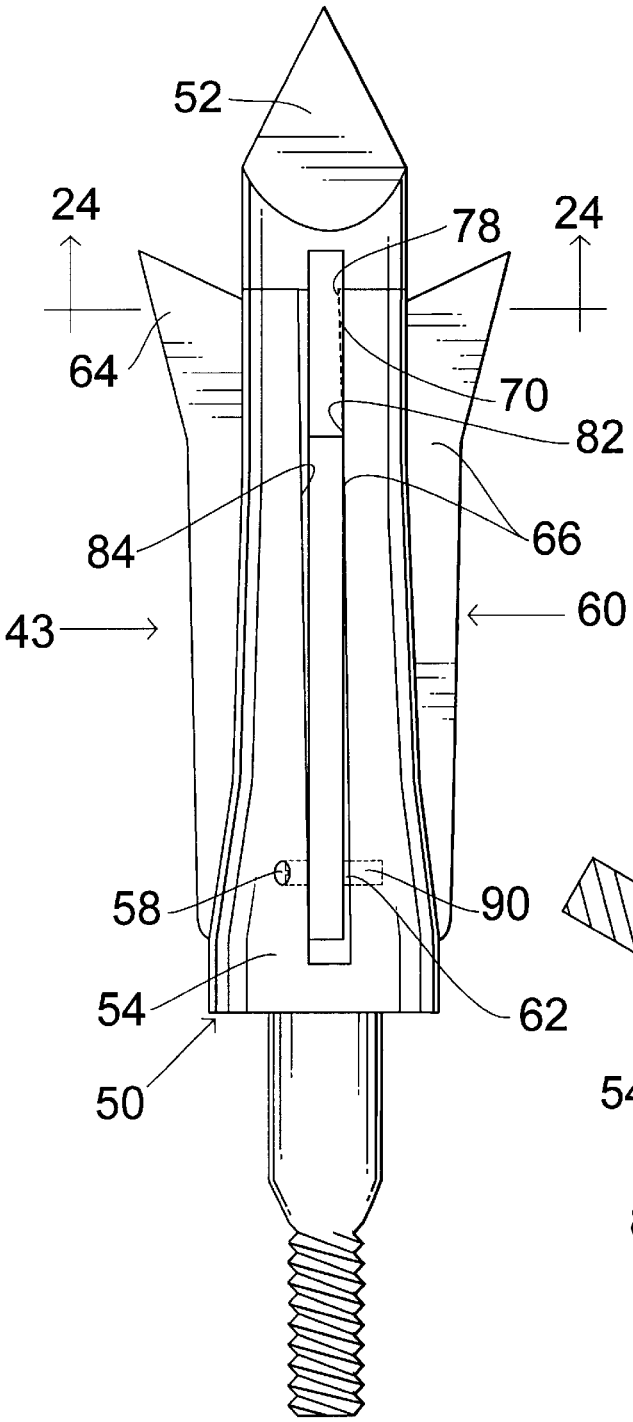
FIG. 23
FIG. 25
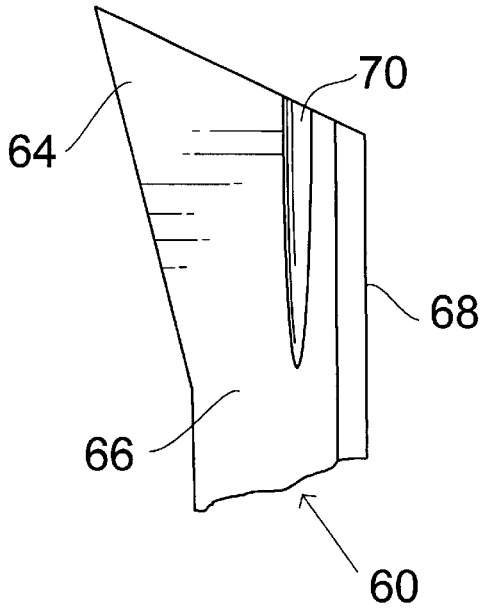
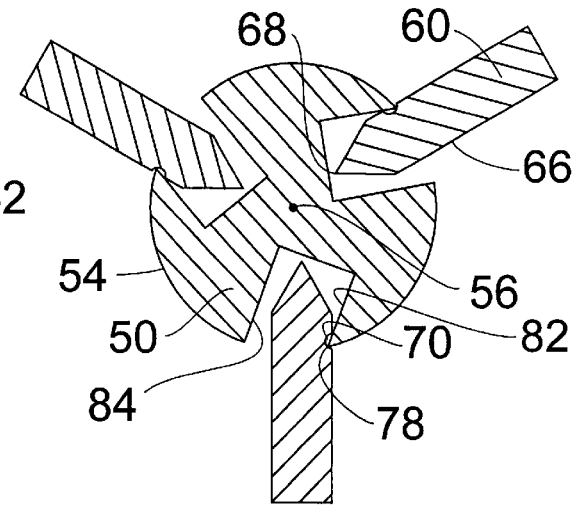
FIG. 24

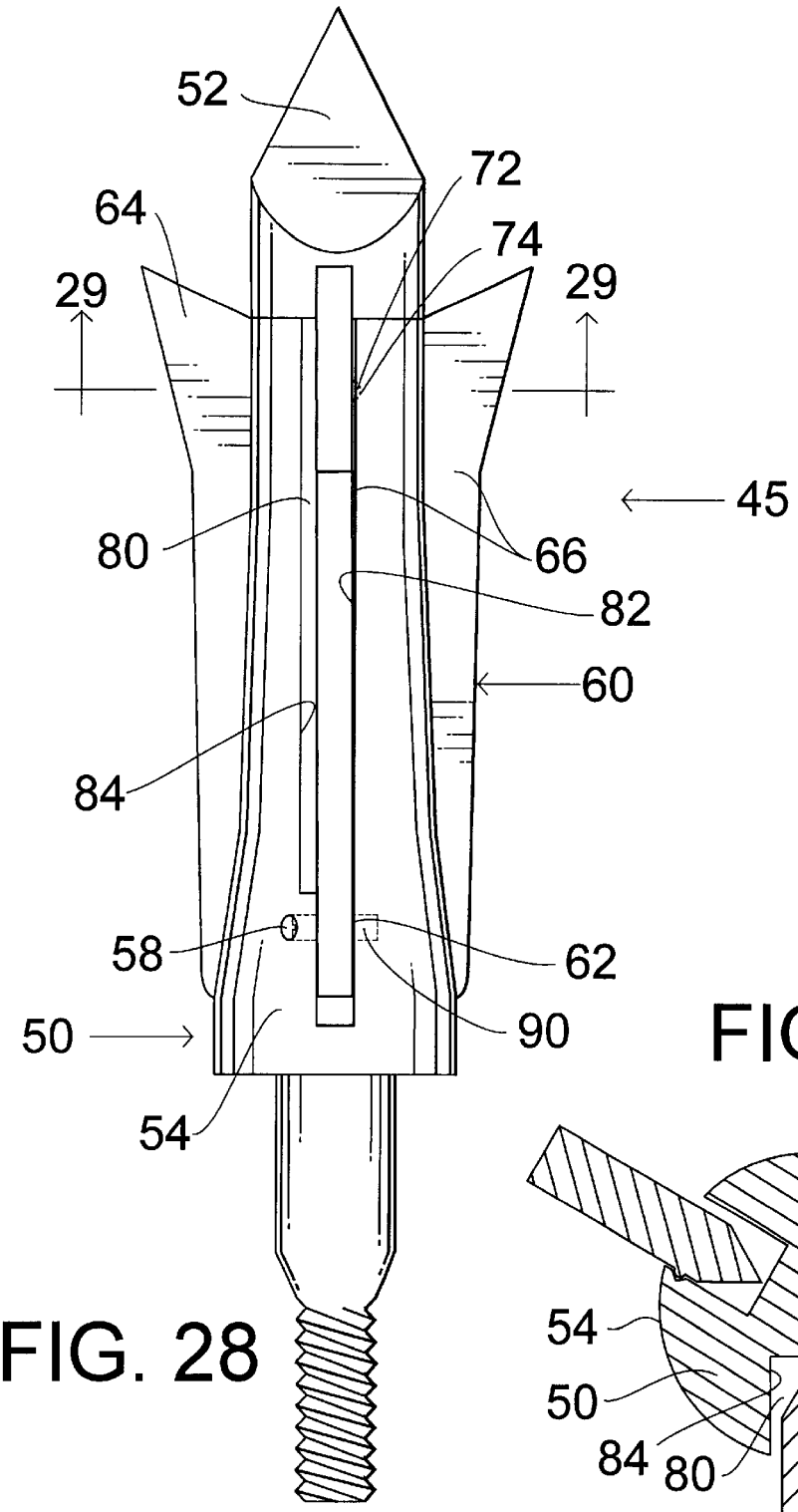
FIG. 28
FIG. 29
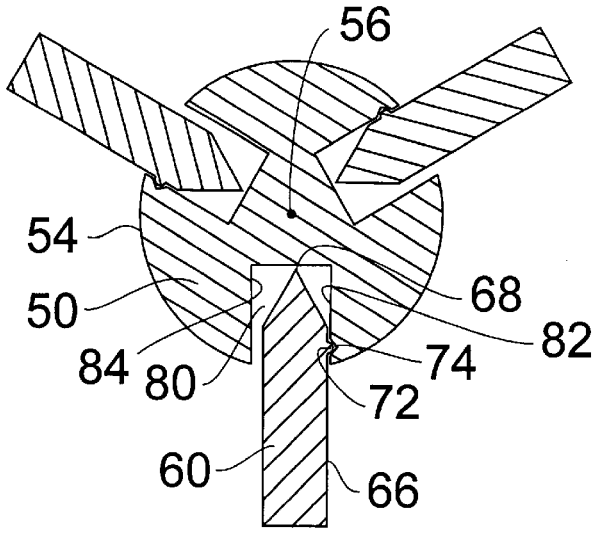

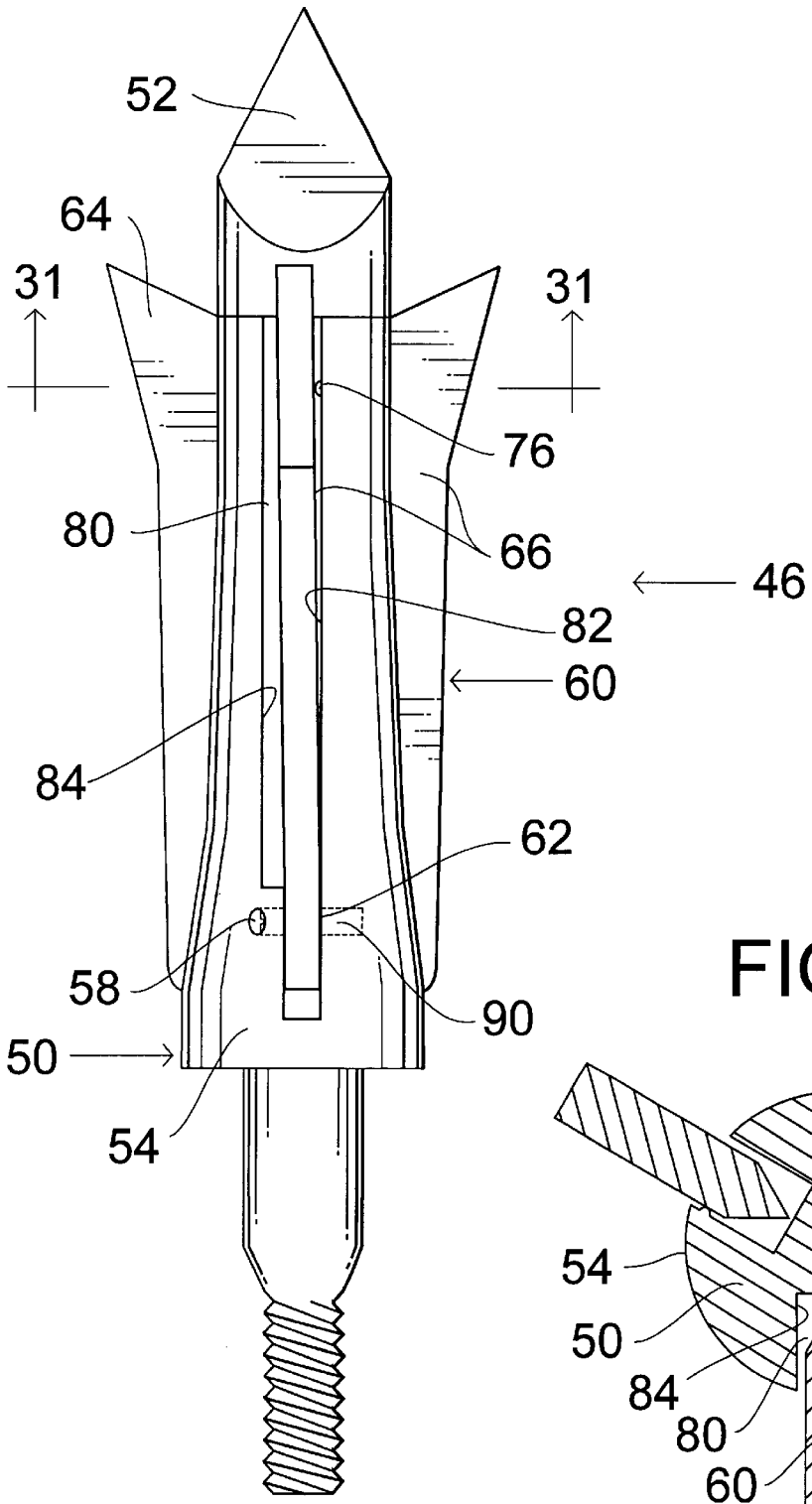
FIG. 30
FIG. 31
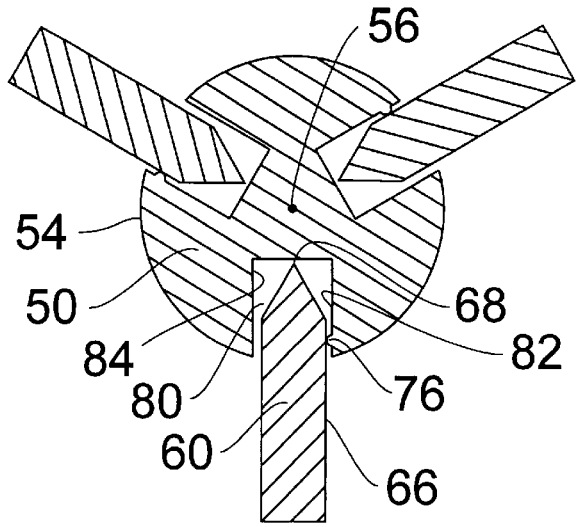

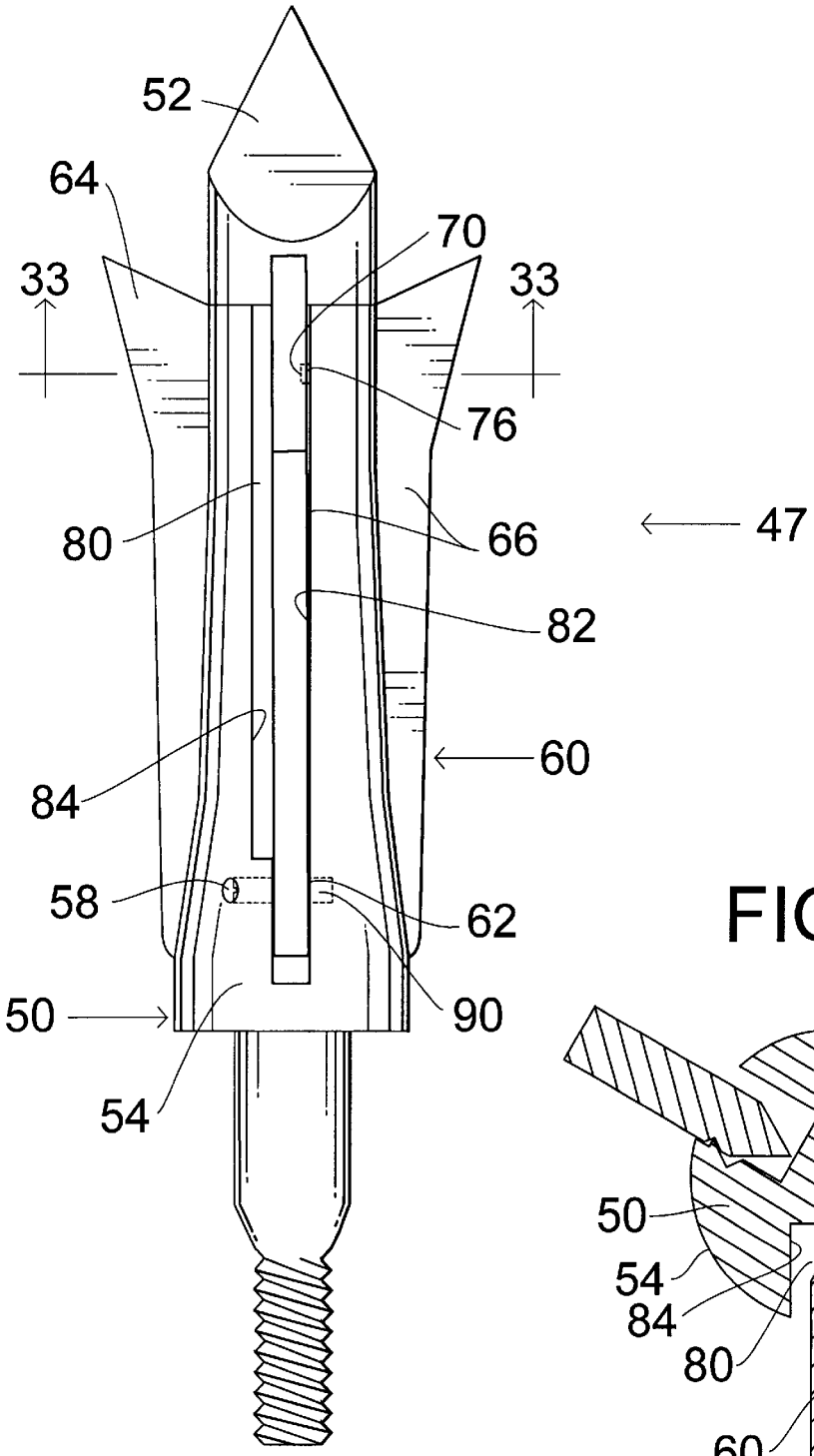
FIG. 32
FIG. 33
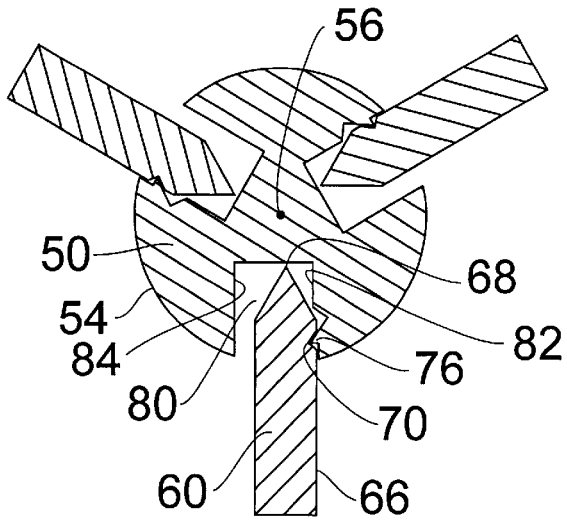

INDEPENDENT BLADE RETENTION FOR BLADE-OPENING ARROWHEADS

This application is a Division of application Ser. No. 08/858,096, filed May 17, 1997, now U.S. Pat. No. 6,171, 206.

BACKGROUND

1. Field of the Invention

This invention relates to arrowheads that have opening blades, and more particularly to non-consumable blade retention for retaining a pivotal blade of a blade-opening arrowhead in the retracted position by methods that are not dependent upon the use of an element or elements in addition to that individual cutting blade, its hinge pin and its blade slot, so that when the arrowhead penetrates an object the blade freely rotates to an open position.

2. Description of Prior Art

Arrows have long been used for war, hunting and competitive sports. A conventional arrow has a shaft, a nock at one end that receives the bow string, an arrowhead or point that attaches to the opposite end, and fletchings. The fletchings are glued to the shaft near the nock end, and help to stabilize the arrow in flight, as it rotates. Arrowheads generally have a pointed forward end, and an opposite threaded shaft end that attaches the arrowhead to the arrow shaft. Arrowheads are also attached to the forward end of arrow shafts by glueing and other methods.

Arrowheads come in a variety of different sizes and configurations depending on their intended use. For example, there are specifically designed arrowheads for competitive target shooting, shooting fish, hunting birds or small game animals, and for hunting big game animals.

The most common type of arrowhead used in hunting is the fixed-blade arrowhead, which has a pointed tip end used for penetrating, and fixed blades or non-pivotal blades that each have a razor sharp edge for cutting. Conventional fixed-blade arrowheads blades are held in a fixed position on the arrowhead, and most such blades are replaceable. The replaceable blades attach to the arrowhead body in longitudinal grooves called blade slots. The tip of the arrowhead may be separably attachable to the arrowhead body or may be integral with it. Arrowheads for hunting are generally known as broadheads.

Arrowheads used for hunting, kill the game animal by cutting vital organs such as the lungs and vascular vessels such as arteries, which causes rapid hemorrhaging and/or suffocation. Quick and humane kills are dependent on accurate shot placement, and upon the amount or volume of the animal tissue that is cut. Hunting arrowheads that cut more tissue are more lethal, and therefore are better. The volume of tissue that is cut is determined by the cutting diameter of the arrowhead, the number of blades it contains, and by the distance the arrowhead penetrates into the animal. The cutting diameter of an arrowhead is determined by how far each cutting blade extends outward from the arrowhead body. The further the blades extend outward the larger the cutting diameter is, and therefore the more cutting potential the arrowhead has.

A problem with conventional fixed-blade arrowheads is that having the desirable, large cutting diameters generally cause unstable arrow flight or poor arrow aerodynamics, which affects accurate shot placement. This can lead to non-lethal wounding of the game animal or missing the animal altogether. Unstable arrow flight in hunting arrows is generally caused by arrowhead aligning and centering problems. Arrowhead aligning and centering problems are prevalent when the arrowhead is attached to the arrow shaft such that the longitudinal axis of the arrowhead is not in line with the longitudinal axis of the arrow shaft. Alignment and centering problems in arrowheads are generally created by low tolerances or sloppiness in the manufacturing of the arrowhead body. When a mis-aligned arrowhead is attached to an arrow and the arrow is shot, as the arrow spins or rotates in flight non-stabilizing forces are induced on the front end of the arrow and cause inconsistent or erratic flight, which steers the arrow from its intended path. Since the cutting blades of fixed-blade arrowheads extend out from the arrowhead body when the arrowhead is in flight, the blades greatly magnify any non-stabilizing forces induced on the arrow from mis-alignment, and therefore increase erratic arrow flight. This in the main reason why conventional fixed-blade arrowheads are limited in the maximum cutting diameter they can have, while retaining sufficiently stable aerodynamics.

To create a hunting arrowhead that has both a maximum cutting diameter and stable aerodynamics, despite moderate manufacturing tolerances, blade-opening arrowheads were designed. Blade-opening arrowheads differ from conventional fixed-blade arrowheads in that the cutting blades are folded up or held adjacent to the arrowhead body in a retracted position while the arrow is in flight, but at impact with the game animal rotate or pivot into an open position, therefore exposing the sharp blade edges and cutting the animal. Since the blades of blade-opening arrowheads are held adjacent to the arrowhead body and do not extend very far out from it, any aligning or centering problems of a blade-opening arrowhead attached to an arrow will not noticeably steer the arrow or undesirably affect its flight trajectory. In this manner blade-opening arrowheads can have both a desirable large cutting diameter, and the stable arrow flight characteristics necessary for accurate shot placement. Blade-opening arrowheads can therefore potentially be more lethal.

Blade-opening arrowheads, like conventional fixed blade arrowheads generally have an elongated arrowhead body, a tip end, and a threaded opposite end. The blades of blade-opening arrowheads have an attachment end which attaches the blades to the arrowhead body by a pivot pin, so that the blades can pivot or rotate in a plane between a first selectable position—the retracted position, and a second selectable position—the open position. Blade-opening arrowheads also come in a variety of different types and styles. The blades of the most common type of blade-opening arrowheads, when in the retracted position have a leading blade end positioned near the tip of the arrowhead that protrudes outward from the arrowhead body, and is sometimes shaped like a wing. The leading blade ends of the most common type of blade-opening arrowheads, rotate away from the arrowhead body in a rearward direction when penetrating an animal. Particularly, the leading blade ends catch on the animal's surface and serve to lever or rotate the blades into the open position, thus exposing the sharp cutting edges of the blades and cutting the animal. The blades of blade-opening arrowheads are also received in blade slots, which are machined or formed into the side of the arrowhead body.

Blade-opening arrowheads for hunting big game must be non-barbing, wherein the blades when in the open position must not inhibit or prevent arrow extraction from a game animal by barbing into the animal tissue. This makes it so non-fatally wounded animals can easily pull out an arrow still lodged in them. For a blade-opening arrowhead to be non-barbing, the pivotal blades must rotate forward from the open position to an angle greater than ninety degrees, as measured between the rear edge of each blade and a location on the arrow shaft rearward of the blades.

Blade-opening arrowheads generally do not penetrate as deep as conventional fixed-blade arrowheads. This has a variety of causes, one in particular occurs when the blades are non-radially aligned with respect to the longitudinal axis of the arrowhead body such that a net pulling force is exerted on each blade when penetrating an object which causes the arrowhead to spin or twist. Spinning reduces penetration by driving the flat blade sides into uncut tissue, which causes friction and therefore depletes kinetic energy that could otherwise further penetration. Non-radial blade alignment is created when the blades are not situated in line with a radius line extending from the longitudinal center of mass of the arrowhead body or the longitudinal axis, to the exterior surface of the arrowhead body. The rate of spin or the spin capacity of conventional blade-opening arrowheads is limited to the extent of the pulling force exerted upon on the arrowhead body by non-radial aligned blades.

Reduced penetration in blade-opening arrowheads can be both desirable and undesirable depending on the type of game animal hunted and the type of wound channel desired. Reduced penetration from spinning when hunting big game animals is generally undesirable, unless the archer is shooting an extremely powerful bow and complete arrow pass-through is assured, and then a twisted wound channel with possibly more tissue damage may be desirable. Reduced penetration from spinning in blade-opening arrowheads for hunting wild turkeys and other small game animals is very desirable since an arrow lodged in a wild turkey greatly limits the distance the bird can retreat after being shot. Therefore reduced arrow penetration aids in increasing the recovery rate of arrowed small game animals.

To hold the blades of blade-opening arrowheads in the retracted position during flight until the arrowhead penetrates the animal, annular retention members such as O-rings are most commonly used. Other commonly known annular retention members are, rubber bands, tight fitting plastic sleeves, tape, heat-shrinkable fitting plastic sleeves, and other wrap materials. When the O-rings are stretched around the outside of the blades they exert a resistive force against the blades and hold the blades selectively in the retracted position.

O-ring use for blade retention is less than ideal. The elastomeric polymer materials are susceptible to drying-out and therefore cracking, which can lead to breaking of the O-ring during arrow acceleration when the arrow is shot. This will cause premature blade-opening and produce extremely erratic arrow flight and possible non-lethal wounding of the game animal. This may also cause severe lacerations to the archer. Also, bows shooting arrows at very high speeds can require as many as three O-rings to prevent premature blade-opening. The experience of learning this can be very undesirable for the archer. O-rings are a consumable item designed for one shot use, and the cost of constantly replacing them is a detrimental factor. Also, they are not user-friendly and are a general bother to worry about while out in the field.

Aside from consumer use considerations, humaneness to the hunted game animal is an important consideration as well. When the arrowhead penetrates the animal and the blades begin to rotate open, the more the O-ring is stretched the more resistive force it exerts back against the blades, thus impeding the rate of blade-opening. This can possibly prevent full blade-opening and a quick and humane kill. Also, extreme weather temperatures greatly affect the elasticity of O-rings; cold weather decreases elasticity which increases the likelihood of the blades not opening, and hot weather increases elasticity which increases the likelihood of premature blade opening.

Attempts in the prior art have been made to remedy the problems associated with O-ring use for blade retention of blade-opening arrowheads, but these attempts have their own problems as well. For example, the use of magnetism for blade retention is known to the art. The disadvantages of using magnets for blade retention are that magnets are heavy, relatively expensive, and can demagnetize. Also known to the art for retaining a pair of blades commonly mounted on a pivot pin in a single blade slot where the blades rotate to opposing sides of the arrowhead body substantially 180 degrees apart when in the open position, is the use of a blade slot that has a narrower opening between opposing blade slot sidewalls at the forward limiting end of the blade slot, where the opening is wider than the width of a blade, such that each blade is biased when in the retracted position. A disadvantage of such narrower blade slot blade retention is that according to such a design a single individual blade cannot be retained in the retracted position without the interaction of the other blade. This means that for producing a desirable, maximum diameter cut from more than two opened blades distributed substantially equidistantly about the perimeter of the arrowhead body, such as the more lethal very popular three blade 120 degree displaced blade design, from such a narrower blade slot blade retention design, requires having two layers of blades or blade slots. Having to accommodate two layers of blade slots in an arrowhead body is a major disadvantage since it will add a significant amount of mass to the arrowhead body and thus decrease arrow velocity, which is in direct contrast to the current strong market trend for fast, flat-shooting arrows. Also commonly known to the art for retaining a blade in the retracted position is the use of an element or elements in addition to that cutting blade, its blade slot and its pivot pin. Examples of such required additional elements for blade retention are: spring elements such as leaf springs or cantilevers, shear rods, O-rings, and another blade. Disadvantages of using additional elements for blade retention are, increased cost, decreased user-friendliness, manufactural complexity, and increased probability of malfunction since the more parts required to perform a function the greater likelihood there is for failure. Disadvantages of other blade retention methods known to the art are, reduced penetration of the arrowhead, structural weakening of various arrowhead elements, in-operability, and manufactural unfeasibleness.

It is apparent that there are much needed improvements in blade-opening arrowheads, both in consideration of the archery consumer and the hunted game animal.

It is apparent that there is a need for a blade-opening arrowhead that securely holds each blade selectively in a retracted or in-flight position, in a secure or locked manner by methods other than O-rings or similar consumable elements.

It is also apparent that there is a need for a blade-opening arrowhead that securely holds each blade selectively in a retracted or in-flight position, in a secure or locked manner, by methods that utilize a minimal number of parts so as to be manufacturally simple, cost effective, structurally strong, user-friendly and to therefore reduce the probability of failure.

It is also apparent that there is a need for a blade-opening arrowhead that is capable of providing increased spinning so as to decrease penetration sufficiently to prevent complete arrow pass-through in wild turkeys, especially when shooting the popular, powerful, flat shooting, and accurate bows.

It is yet further apparent that there is a need for a blade-opening arrowhead that is capable of providing increased spinning so as to provide a more traumatized and damage inflicted wound channel.

SUMMARY OF THE INVENTION

It is one object of the present invention to provide blade-opening arrowheads with blade retention methods that do not require the use of consumable elements such as O-rings.

It is another object of the present invention to provide blade-opening arrowheads that require a minimum number of parts or elements for blade retention so as to be manufacturally simple, cost effective, structurally strong, user-friendly and to therefore be less susceptible to failure.

It is another object of the present invention to provide blade-opening arrowheads having a plurality of blades, where each blade is independently securely held selectively in a retracted in-flight position, in a secure or locked manner.

It is another object of the present invention to provide blade-opening arrowheads that securely hold each blade selectively in a retracted in-flight position, in a secure or locked manner where a rigid non-flexible bias element cams each blade within its respective blade slot so that each blade is securely held adjacent to the arrowhead body by frictional engagement when in the retracted position.

It is another object of the present invention to provide blade-opening arrowheads that securely hold each blade selectively in a retracted or in-flight position, in a secure or locked manner where the plane each blade rotates in is not parallel to a partially bounding sidewall of the blades's corresponding blade slot, such that each blade biasly engages against the sidewall and is securely held adjacent to the arrowhead body by frictional engagement when in the retracted position.

It is another object of the present invention to provide blade-opening arrowheads that securely hold each blade selectively in a retracted or in-flight position, in a secure or locked manner where each blade engages with a corner formed at the juncture of the exterior surface of the arrowhead body and a partially bounding sidewall of each blade's corresponding blade slot, so that each blade is securely held adjacent to the arrowhead body by frictional engagement when in the retracted position.

It is another object of the present invention to provide blade-opening arrowheads that securely hold each blade selectively in a retracted or in-flight position, in a secure or locked manner where the opening between opposing sidewalls of each blade slot is wider toward the forward end of the blade slot, and where a rigid non-flexible bias element cams each blade within its respective blade slot so that each blade is securely held adjacent to the arrowhead body by frictional engagement when in the retracted position.

It is still another object of the present invention to provide blade-opening arrowheads that securely hold each blade selectively in a retracted or in-flight position, in a secure or locked manner where the opening between opposing sidewalls of each blade slot for at least a portion of the blade slot is narrower than the thickness of a blade when a blade is not retracted therein, wherein when each blade is retracted into the retracted position the sidewalls of its blade slot are flexed so that each blade is securely held adjacent to the arrowhead body within its blade slot by frictional engagement.

It is still another object of the present invention to provide blade-opening arrowheads that securely hold a pair of blades in a single blade slot selectively in a retracted or in-flight position, in a secure or locked manner where the opening between opposing sidewalls of the blade slot for at least a portion of the blade slot is narrower than the thickness of both blades when the blades are not retracted therein, wherein when the blades are retracted into the retracted position the sidewalls of the blade slot are flexed so that the blades are securely held adjacent to the arrowhead body within their blade slot by frictional engagement.

It is yet further another object of the present invention to provide blade-opening arrowheads that provide increased spinning capacity, thus to provide a more traumatized wound channel, and/or to reduce penetration such to prevent complete arrow pass-through in wild turkeys and other small game animals, particularly when using powerful, accurate, flat-shooting bows.

The foregoing objects and advantages and other objects and advantages of the present invention are accomplished with a hunting arrowhead that attaches to the forward end of an arrow shaft, where a plurality of blades are pivotally or hingedly connected to an arrowhead body. The blades freely rotate in a plane from an in-flight retracted first selectable position to an open second selectable position when the arrowhead penetrates an object, or when acted upon by a sufficient opening force.

Such a blade-opening arrowhead according to one preferred embodiment of this invention has an arrowhead body with a tip end used for initial penetration and an opposing threaded shaft end that screws or threads the arrowhead to an arrow. The tip end may be removably attached to the arrowhead body, and may be made of material different than the rest of the arrowhead body. The arrowhead body has a plurality of three blade slots substantially equally distributed 120 degrees about the perimeter of the arrowhead body, with one blade in each respective blade slot. Each blade has a first end, an opposing second end, a face extending between the ends on each blade side, and an edge extending about its periphery. One blade edge of each blade is sharpened for cutting. The first blade ends or the leading ends each have a protruding wing that is exposed out from the arrowhead body when the blades are in the retracted position. The wings serve to increase the moment-arm for levering or rotating the blades to the open position. The second end of each blade has an aperture or hinge pin receiving hole for receiving a pivot pin or a hinge pin. The arrowhead body also has a hinge pin receiving hole for each blade. The arrowhead body hinge pin receiving holes are recessed or drilled into the two opposing sidewalls of each blade slot, and are threaded to receive the threaded hinge pins. A single hinge pin is used for each blade, and when the blades are positioned in the blade slots, each hinge pin is extended through the aperture of a corresponding blade and is screwed into the arrowhead body. This pivotally connects the blades to the arrowhead body, so that each blade rotates in a plane between the retracted position and the open position. The hinge pin receiving holes are drilled non- perpendicularly to the blade slot sidewalls, but the hinge pins extend perpendicularly through the blades when extended through the apertures of the blades when the blades are mounted to the arrowhead body. This makes it so that the plane that each blade rotates in is not parallel to the sidewalls of its corresponding blade slot. The openings between the sidewalls of the blade slots are wider than the blade thickness so that when the blades are folded up into the blade slots in the retracted position, a face or side of each blade biasly engages against a rigid, non-flexible sidewall and each blade is camed or flexed such that it remains independently securely held selectively in the retracted position by frictional engagement without the use of any element or elements in addition to that respective blade, its blade slot and its hinge pin. This makes a very simple to use and effective blade-opening arrowhead because, there are no additional elements to hassle with, a large diameter preferably more than two blade cut wound is attainable, and the arrowhead has no unnecessary weight and therefore provides more accurate or flatter-shooting arrows. The force generated from caming or flexing each blade is strong enough to maintain the blades in the retracted position when the arrow is exposed to incidental forces, such as those produced from transporting the bow, nocking an arrow to the bow string, and acceleration when the arrow is shot, but is weak enough, to be easily overcome when the arrow impacts or begins to penetrate a game animal. The width of the blade slot openings are wide enough to allow the blades to freely rotate to the open position and to seat within the blade slot when in the open position with a snug and wobble-free fit. When rotated to the open position the blades abut against the arrowhead body, thus defining the cutting diameter of the arrowhead.

The plane each blade rotates in, or is in when in the open position, may be parallel to the longitudinal axis of the arrowhead body or may be non-parallel to the longitudinal axis of the arrowhead body depending on the angular orientation the blade slots are machined or fabricated within the arrowhead body. When the opened blades are aligned non-parallely to the longitudinal axis of the arrowhead, the arrowhead will spin when penetrating an object since a flat blade face or side of each blade will be angled or inclined such that the inclined faces are exposed in the forward direction the arrowhead is traveling. This will make it so the inclined faces contact uncut tissue such that a net force will be produced perpendicularly to the longitudinal axis of the arrowhead and thus cause the arrowhead to spin. Modifications in the machining or fabricating process of the arrowhead body blade slots that produce different inclination or sloped orientations of the opened blades with respect to the longitudinal axis of the arrowhead body, will produce blade-opening arrowheads that have different spin capacities. This variability in the amount of spinning capacity makes it possible to produce blade-opening arrowheads with reduced arrow penetration sufficient enough to prevent complete arrow pass-through in wild turkeys when shooting the very popular, powerful, and therefore accurate, and flat-shooting bows. This spinning capacity is also capable of producing a twisted wound channel with potentially more trauma and damage being done to the cut tissue within the channel's path.

Blade-opening arrowheads according to other preferred embodiments of this invention differ from the above described preferred embodiment in that the face of each blade biasly engages against an exterior corner formed at the juncture of a blade slot sidewall and the exterior surface of the arrowhead body. Each blade slot sidewall of each engaging corner is sloped relative to the plane its respective blade rotates in such that the leading ends of the blades intersect with the corners when the blades are folded into the retracted position. The radial alignment, with respect to the longitudinal axis of the arrowhead body, of the sidewalls of each blade slot is substantially non-parallel to the radial alignment of the plane that each respective blade rotates in such that each blade is diagonally disposed within its blade slot when in the retracted position so that an inside angle is formed between the face of each blade and the corresponding blade slot sidewall. According to one such embodiment the face of each blade has a recess formed in it such that when the blades are in the retracted position the recesses receive the corners thus independently securely holding each blade selectively in the retracted position. According to another such embodiment the face of each blade has a rigid, non-flexible knob protruding from it such that when the blades are in the retracted position the knobs bias against the corners thus independently securely holding each blade selectively in the retracted position. Particularly the knobs bias against the sidewalls of the blade slots medially to the corners, as determined with respect to the longitudinal axis of the arrowhead body.

Blade-opening arrowheads according to other preferred embodiments of this invention differ from the above described preferred embodiments in that the width of the blade slot opening between opposing sidewalls is larger toward the forward end of the blade slot, and the plane each blade rotates in is parallel to the sidewalls of its blade slot. According to such embodiments a rigid non-flexible bias element protrudes out from either each blade face or from a sidewall of each blade slot and serves to cam or flex each blade within its blade slot, thus independently securely holding each blade selectively in the retracted position by frictional engagement. The bias element of the blades and blade slot sidewalls are integrally formed thereupon.

Blade-opening arrowheads according to yet other preferred embodiments of this invention differ from the above described preferred embodiments in that the sidewalls of the blade slots are flexible or resilient, preferably being molded of a composite resin. According to one such embodiment, each blade slot has a slot opening width between opposing blade slot sidewalls for at least a portion of the blade slot that is narrower than the thickness of a blade, as determined when the blades are not positioned in the blade slots in the retracted position. Each blade also rotates in a plane substantially parallel to the sidewalls of its blade slot. According to such embodiment, when each blade is folded up into the retracted position between the resilient sidewalls of the blade receiving slots, the slot sidewalls are flexed and each blade is thus independently securely held selectively in the retracted position by frictional engagement.

When the arrowheads according to the above described preferred embodiments of this invention initially penetrate an animal, the first ends or leading ends of the blades catch on the animal's surface and the blades are easily levered out as the frictional engagement is overcome, whereupon the blades freely rotate toward the open position. All that is required to securely re-lock the blades back in the retracted position, is to simply push each blade back into the retracted position, whereupon the frictional engagement selectively retains each blade in the retracted position. There is no requirement to spend additional time and effort handling other elements.

The blade-opening arrowheads according to this invention, use no consumable items such as O-rings, for blade retention. The blade-opening arrowheads according to this invention provide blade retention methods that require less parts or elements than prior art blade-opening arrowheads. This provides blade-opening arrowheads which are more cost effective, simpler to manufacture and to use, and less susceptible to failure. The blade-opening arrowheads according to this invention provide blade retention methods that are not suspectable to malfunctioning when exposed to the harsh conditions commonly encountered in the field, and when subjected to prolonged use. The blade-opening arrowheads according to this invention are also structurally strong, and operable.

The blade-opening arrowheads according to this invention provide increased spinning capacity which can create a more traumatized wound channel, and reduce penetration sufficiently to prevent complete arrow pass-through in wild turkeys and other small game animals even when using powerful, accurate, flat-shooting bows.

As has been shown in the above discussion, the blade-opening arrowheads according to this invention overcome deficiencies inherent in prior art arrowheads.

With the above objects and advantages in view, other objects and advantages of the invention will more readily appear as the nature of the invention is better understood, the invention is comprised in the novel construction, combination and assembly of parts hereinafter more fully described, illustrated, and claimed.

BRIEF DESCRIPTION OF THE DRAWINGS

FIG. 1 shows an arrow having a blade-opening arrowhead according to one preferred embodiment of this invention attached to the forward end of an arrow shaft, with the blades in the retracted position wherein each blade slot is non-parallely aligned with the plane each corresponding blades rotate in;

FIG. 20 is a perspective view of another preferred embodiment according to this invention showing each blade slot non-parallely aligned with the plane each corresponding blade rotates in where a rigid, non-flexible knob on each blade is engaged with a corner at the juncture of a blade slot sidewall and the exterior surface of the arrowhead body of each blade slot;

FIG. 21 is a cross-sectional view taken along line 21—21 of FIG. 20;

FIG. 22 is a side view of the leading end of a blade according to the preferred embodiment as illustrated in FIG. 21, showing a rigid, non-flexible knob;

FIG. 23 is a perspective view of another preferred embodiment according to this invention showing each blade slot non-parallely aligned with the plane each corresponding blade rotates in where a recess formed in each blade is engaged with a corner at the juncture of a blade slot sidewall and the exterior surface of the arrowhead body of each blade slot;

FIG. 24 is a cross-sectional view taken along line 24—24 of FIG. 23;

FIG. 25 is a side view of the leading end of a blade according to the preferred embodiment as illustrated in FIG. 23, showing a recess;

FIG. 28 is a perspective view of another preferred embodiment according to this invention similar to the preferred embodiment as illustrated in FIG. 26, but having a recess formed in a sidewall of each blade slot that receives the rigid, non-flexible knobs extending from the blades;

FIG. 29 is a cross-sectional view taken along line 29—29 of FIG. 28;

FIG. 30 is a perspective view of another preferred embodiment according to this invention where the blade slots are wider toward the forward end of the slots and each blade slot is substantially parallely aligned with the plane each corresponding blade rotates in, and where a rigid, non-flexible knob extending from a sidewall of each blade slot cams the blades in their respective blade slots;

FIG. 31 is a cross-sectional view taken along line 31—31 of FIG. 30;

FIG. 32 is a perspective view of another preferred embodiment according to this invention similar to the preferred embodiment as illustrated in FIG. 30, but having a recess formed in each blade that receives the rigid, non-flexible knobs extending from the blade slots;

FIG. 33 is a cross-sectional view taken along line 33—33 of FIG. 32;

Figure 1:
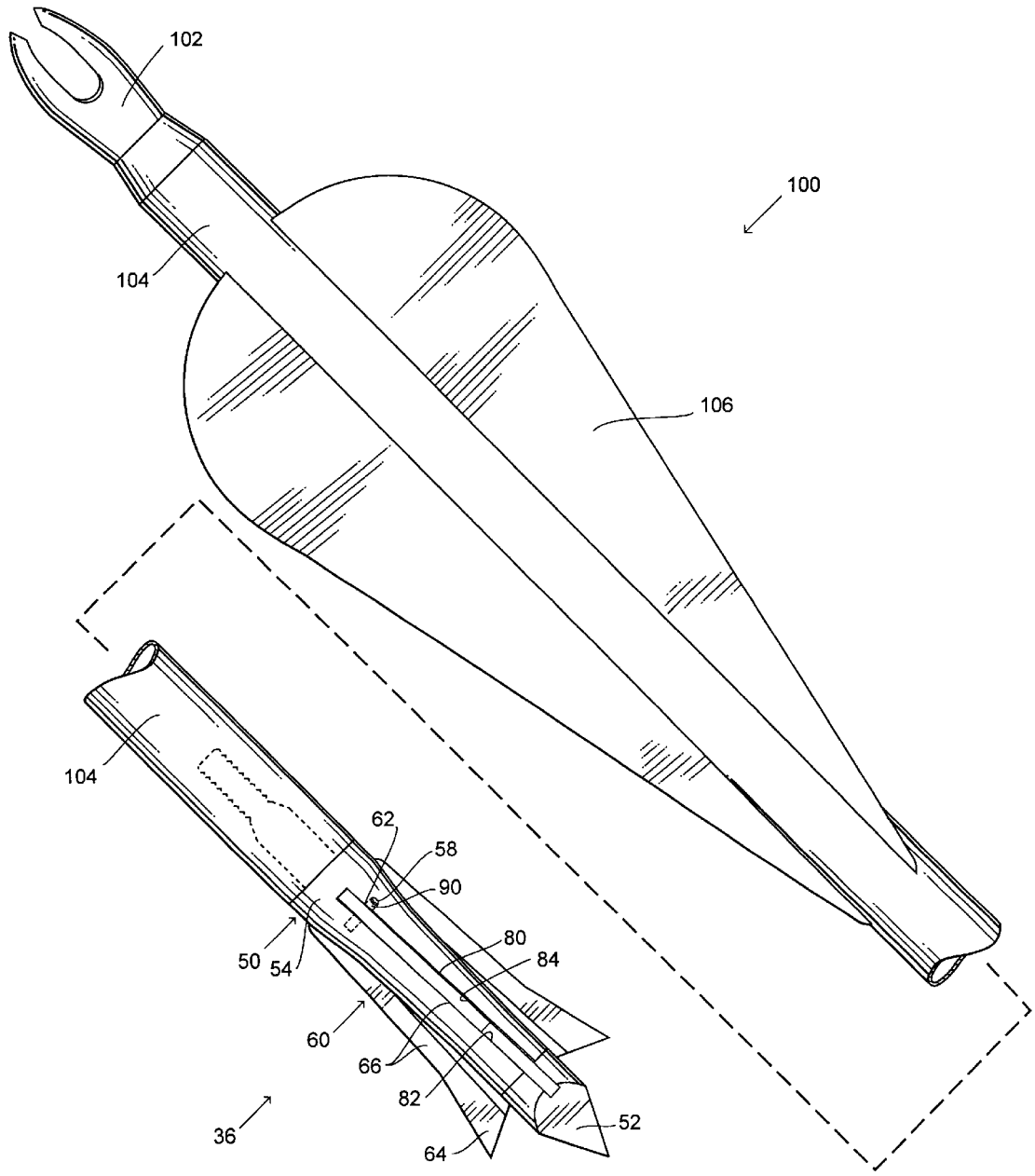

36 blade-opening arrowhead
37 blade-opening arrowhead
38 blade-opening arrowhead
39a blade-opening arrowhead
39b blade-opening arrowhead
39c blade-opening arrowhead
40 blade-opening arrowhead
41 blade-opening arrowhead
42 blade-opening arrowhead
43 blade-opening arrowhead
44 blade-opening arrowhead
45 blade-opening arrowhead
46 blade-opening arrowhead
47 blade-opening arrowhead
48 blade-opening arrowhead
49 blade-opening arrowhead
50 arrowhead body
52 tip
54 exterior surface, arrowhead body
56 longitudinal axis arrowhead body
58 hinge pin receiving hole, arrowhead body
60 blade
62 aperture
64 wing
66 blade face
68 cutting edge
70 recess, blade
72 knob, blade
74 recess, blade slot sidewall
76 knob, blade slot sidewall
78 corner
80 blade slot
82 first sidewall
84 second sidewall
86 first intersecting location
88 second intersecting location -continued 90 hinge pin
92 medial abutting wall
100 arrow
102 nock
104 arrow shaft
106 fletching

DETAILED DESCRIPTION OF THE PREFERRED EMBODIMENTS

It is the overall objective of this invention to simplify blade retention methods for retaining pivotal blades of blade-opening arrowheads selectively in an in-flight retracted position, wherein specifically the blade retention method for retaining a blade in the retracted position is reduced to nothing more than the essential blade-opening arrowhead cutting function elements of, that cutting blade, its hinge pin and its blade slot.

Selectively positioning blades according to this invention means that the position each blade may be placed in is selectable, or that the blades may be positioned in more than one position. Preferably selectable blade positions are the retracted position and the open position. Selectively retaining blades in a retracted or an in-flight position according to this invention is intended to mean that the blades are securely held in the retracted position or in a first selectable position in a locked manner where the blades are securely held adjacent to the arrowhead body until acted upon by a sufficient opening force, whereupon they freely rotate to the open position, or a second selectable position which defines the full cutting diameter of the arrowhead.

Retention means according to this invention mean that a blade is independently retained selectively in the retracted position. Independently retaining a blade selectively in the retracted position or independent blade retention according to this invention has the intended meaning that an individual blade is securely held selectively in the retracted position in its blade slot, adjacent to the arrowhead body by methods which are independent of, or not dependent upon, the interaction of an element or elements in addition to that cutting blade, its blade slot and its hinge pin. Any other element or elements required for retaining that blade in the retracted position are additional elements. A cutting blade or "blade" as used throughout this specification and in the claims is intended to mean the sharp edge of the pivotal blade that performs the cutting function, and any blade material integral therewith that is not capable of being flexed independently of the cutting edge, and includes any rigid, non-flexible shapes or voids formed in such blade material, such as a hinge pin receiving aperture. Additional elements are anything which aids in retaining a blade in the retracted position that is in addition to that cutting blade, its hinge pin and its blade slot. Since a blade slot is essentially a three dimensional void or groove, which is defined, limited or bound by the arrowhead body wherein the blade slot sidewalls are the boundaries on at least two sides of the void, each pair of blade slot sidewalls are thus partially bounding sidewalls of a blade slot. A blade slot therefore according to this invention comprises at least one partially bounding sidewall, preferably two wherein the sidewalls are integrally formed with the arrowhead body and do not have any attached parts, whether integrally or removably so. Any parts or elements attached to the arrowhead or its separate parts, whether integrally so or not, that aid in blade retention of a blade, which are in addition that cutting blade, its hinge pin and its blade slot, are also additional elements.

It is apparent that with the use of other elements, or that with the attachment of certain additional elements, blade-opening arrowheads having the same performance or functional results as the independent blade retention blade-opening arrowheads of this invention are attainable. Such similar equivalent functioning designs are intended to be within the scope of this invention.

Figure 2:
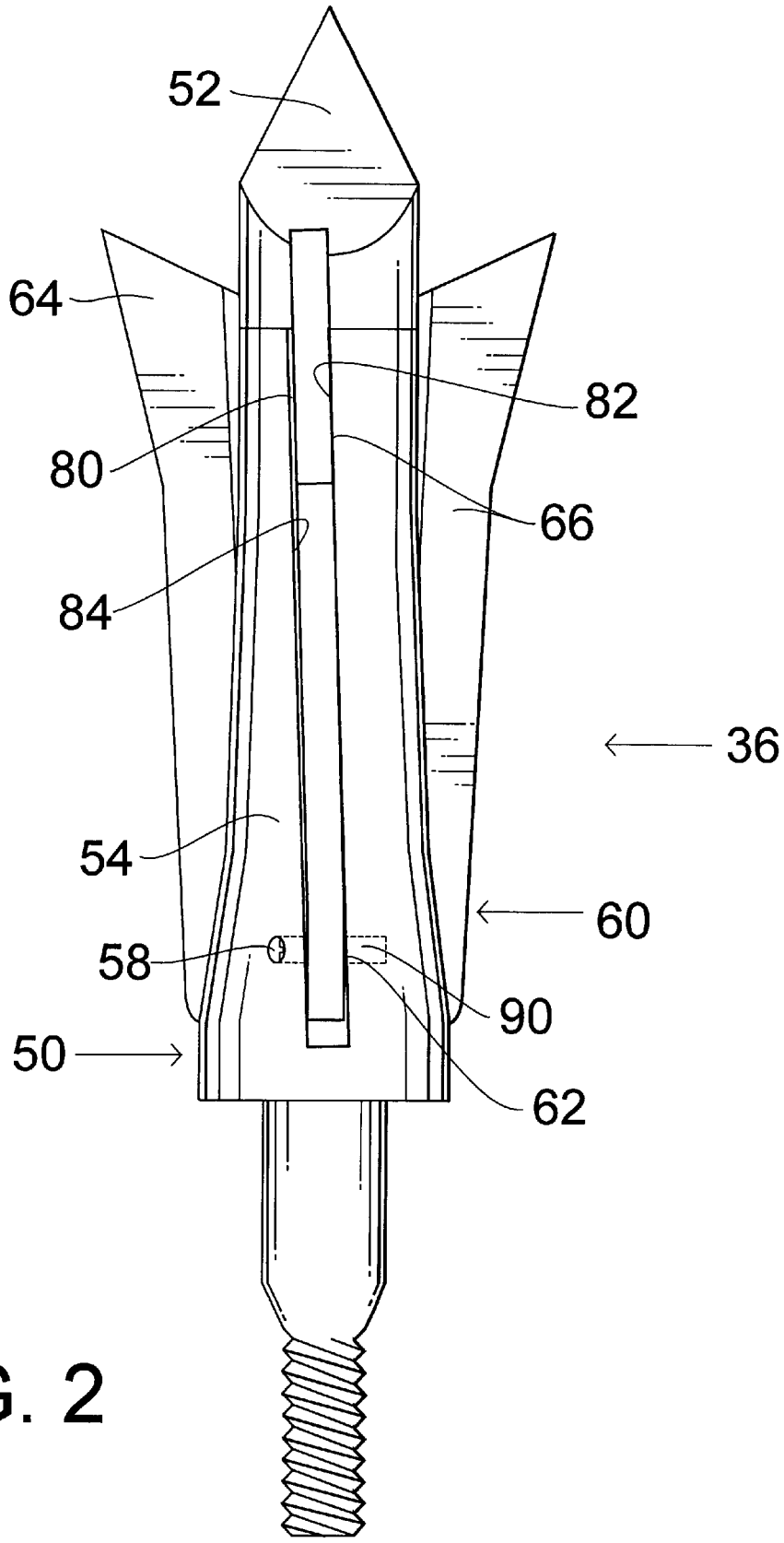
FIG. 2 is a perspective view of the preferred embodiment as illustrated in FIG. 1, showing the arrowhead detached from the arrow shaft.
Figure 3:
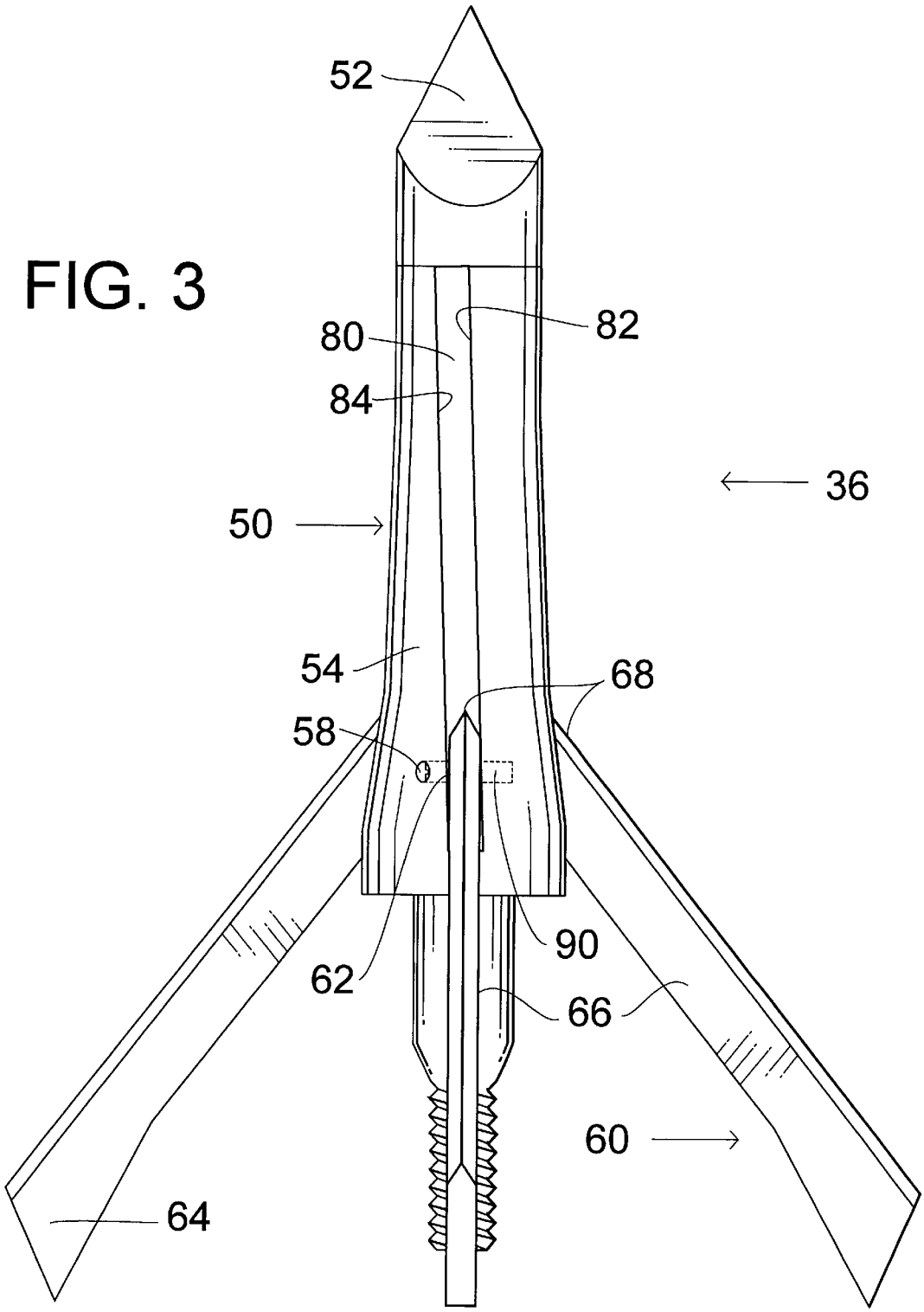
FIG. 3 is a perspective view of the preferred embodiment as illustrated in FIG. 2, showing the blades in the open position.

FIGS. 1–3 illustrate an example of retention means according to this invention wherein FIG. 1 shows a blade-opening arrowhead 36 according to one preferred embodiment of this invention attached to a conventional arrow 100, having a nock 102 for receiving a bow string, an arrow shaft 104, and stabilizing fletchings 106. Blade-opening arrowhead 36 as shown in FIG. 2, has a tip end 52 for initial penetrating, and a plurality of three blades 60 pivotally connected to an arrowhead body 50, each by a hinge pin 90 that is threaded or screwed into a corresponding threaded hinge pin receiving hole 58 in arrowhead body 50. Each blade 60 has a pair of blade faces 66, a razor sharp cutting edge 68, and is positioned within a respective blade slot 80, which communicates with an exterior surface 54 of arrowhead body 50. Blade slots 80 are non-parallely aligned with respect to the longitudinal axis of arrowhead body 50 and each blade slot 80 has a pair of opposing partially bounding sidewalls 82, 84. Hinge pin receiving holes 58 pass through opposing sidewalls 82, 84 of corresponding blade slots 80, for each blade 60. An aperture 62 in one opposing end, or the second end, of each blade 60 has hinge pin 90 extending therethrough, which hingedly connects blades 60 to arrowhead body 50 so that each blade 60 rotates in a plane between the retracted position and the open position where the leading opposing blade end, or the first end, rotates away from the arrowhead body in a rearward direction away from tip end 52. The plane each blade 60 rotates in is substantially radially aligned with and parallel to the longitudinal axis of arrowhead body 50 as shown in FIG. 3. Hinge pin receiving holes 58 are drilled non-perpendicularly to opposing sidewalls 82, 84 of blade slots 80, and hinge pins 90 extend perpendicularly through blades 60 when extended through apertures 62 when blades 60 are mounted to arrowhead body 50. Therefore the plane that each blade 60 rotates in is not parallel to sidewalls 82, 84 of its corresponding blade slot 80. The opening between sidewalls 82, 84 of each blade slot 80 is wider than the thickness of a corresponding blade so that when blades 60 are folded up into blade slots 80 in the retracted position, one face 66 of each blade 60 biasly engages against its respective sidewall 82 wherein each blade 60 is camed or flexed such that it remains securely held selectively in the retracted position by frictional engagement, as is clearly shown in FIG. 2. Each blade 60 is thus independently retained selectively in the retracted position. When exposed to a sufficient opening force such as when penetrating an animal, a wing 64 extending out from the leading end of each blade 60 catches on the animal's surface and blades 60 of arrowhead 36 freely rotate to the open position as shown in FIG. 3. It is apparent that wing 64 can be positioned at different locations along the outside edge of each blade 60, specifically to create an open-after impact blade-opening arrowhead, as is known to the art. As shown in FIG. 3, when in the open position blades 60 are aligned radially with the longitudinal axis of arrowhead body 50 and therefore parallely also. The rearward blunt edges of blades 60 abut against arrowhead body 50 thus stopping their opening rotation and defining the cutting diameter of arrowhead 36.

Blade-stop means according to this invention comprise any element or elements that serve to abut against blades 60, thus stopping their opening rotation at the full cutting diameter. It is apparent that the blunt reward blade edges may abut against a removably attachable washer or equivalent element or against arrowhead body 50 wherein the impact forces transferred to hinge pins 90 are lessened.

According to the preferred embodiments of this invention where the plane that each blade 60 rotates in is not parallel to sidewalls 82, 84 or to a sidewall of its corresponding blade slot 80, the inclined angular difference between the corresponding sidewalls or corresponding sidewall and each blade's rotational plane is sufficient that when blades 60 are folded up into blade slots 80 in the retracted position each blade 60 is camed or flexed such that it remains securely held selectively in the retracted position by frictional engagement. It is apparent that the inclined angular difference between the corresponding sidewalls or corresponding sidewall and each blade's rotational plane may be as little as 2 degrees or less, such as 1 degree or ½ a degree or less, to provide effective blade retention according to this invention.

Figure 4:
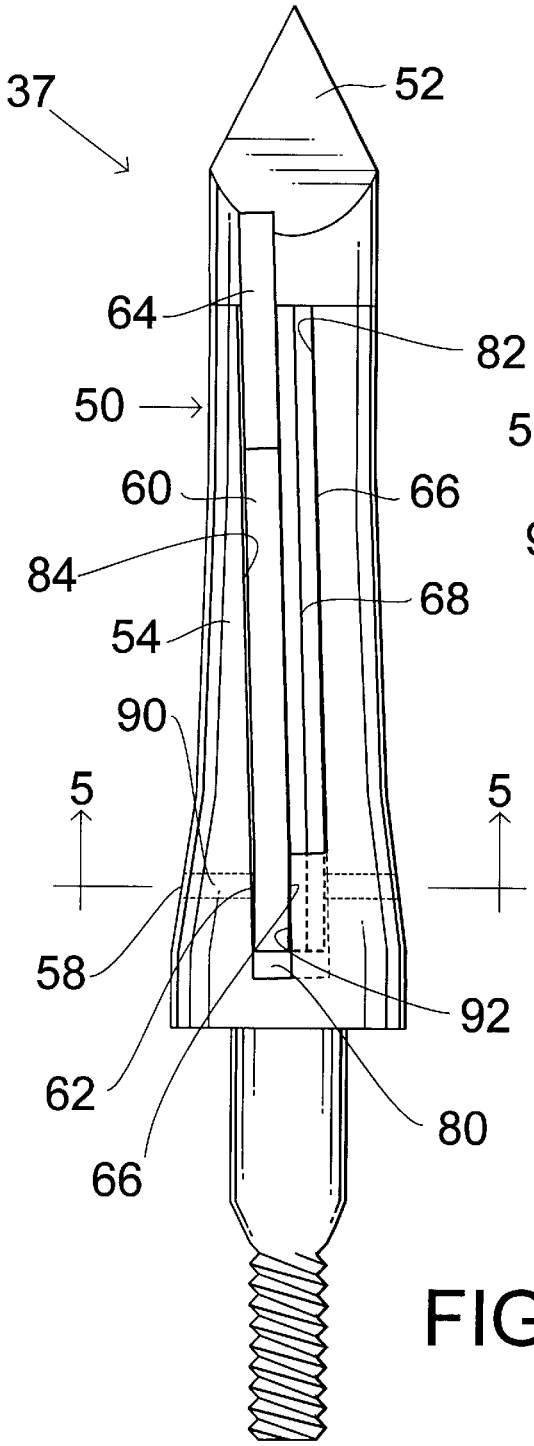
FIG. 4 is a perspective view of another preferred embodiment according to this invention similar to the preferred embodiment as illustrated in FIG. 2, but showing two blades in one slot mounted on a common hinge pin, with the blades in the retracted position.
Figure 5:
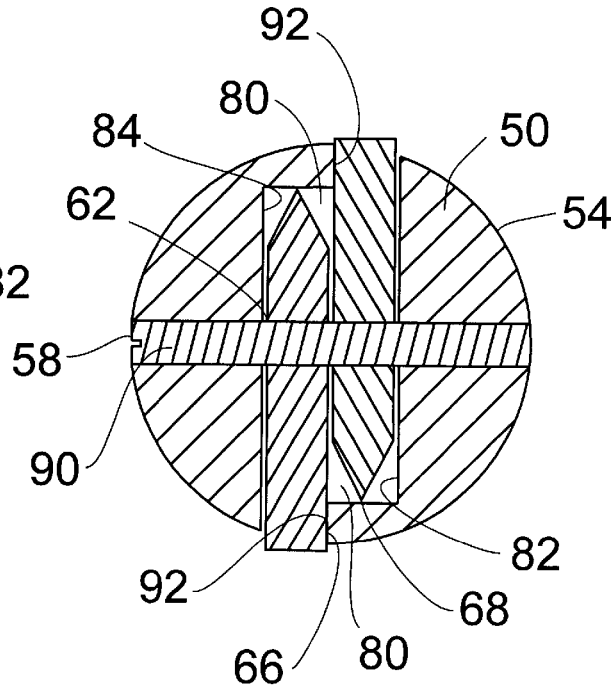
FIG. 5 is a cross-sectional view taken along line 5—5 of FIG. 4.
Figure 6:
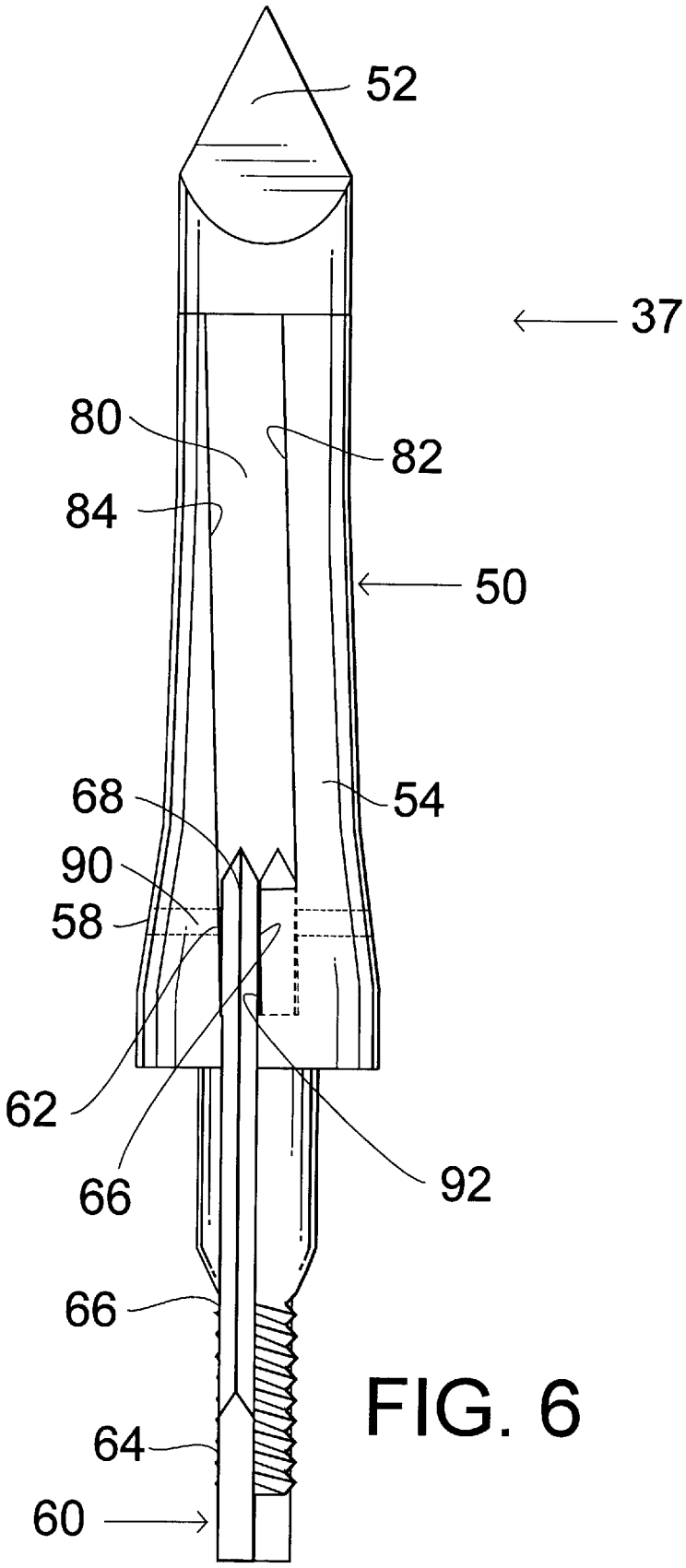
FIG. 6 is a perspective view of the preferred embodiment as illustrated in FIG. 4 showing the blades in the open position.

FIGS. 4–6, illustrate a blade-opening arrowhead 37, another preferred embodiment according to this invention which is similar to the preferred embodiment as illustrated in FIGS. 1–3, except two blades 60 are commonly mounted to hinge pin 90 and both blades 60 are received within a single blade receiving slot 80, which extends to opposing sides of exterior surface 54 of arrowhead body 50. With respect to blade slot 80, medial blade face 66 of each blade abuts against a medial abutting wall 92 such that the blade 60 which biasly engages against sidewall 82 is independently retained in the retracted position wherein the other blade 60 adjacent to sidewall 84 is not, as is shown in FIGS. 4 and 5. It is apparent that with minor modifications to blade slot 80 both blades 60 can be independently retained in the retracted position. For example, this could be accomplished by fabricating the blade slot sidewalls so that the sidewall each blade is positioned adjacent to when in the retracted position leans inward or medially toward the center of the blade slot, so that each blade is camed of flexed between its respective medial abutting wall and its adjacent leaning sidewall when in the retracted position.

Figure 7:
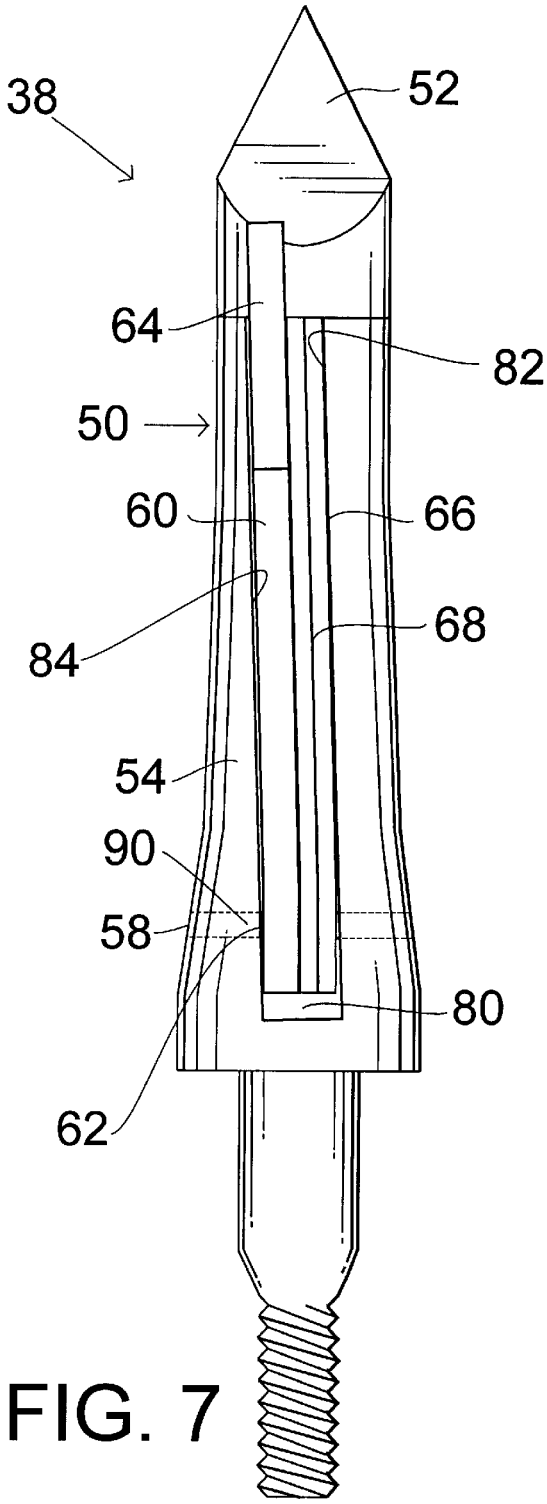
FIG. 7 is a perspective view of another preferred embodiment according to this invention similar to the preferred embodiment as illustrated in FIG. 4.
Figure 8:
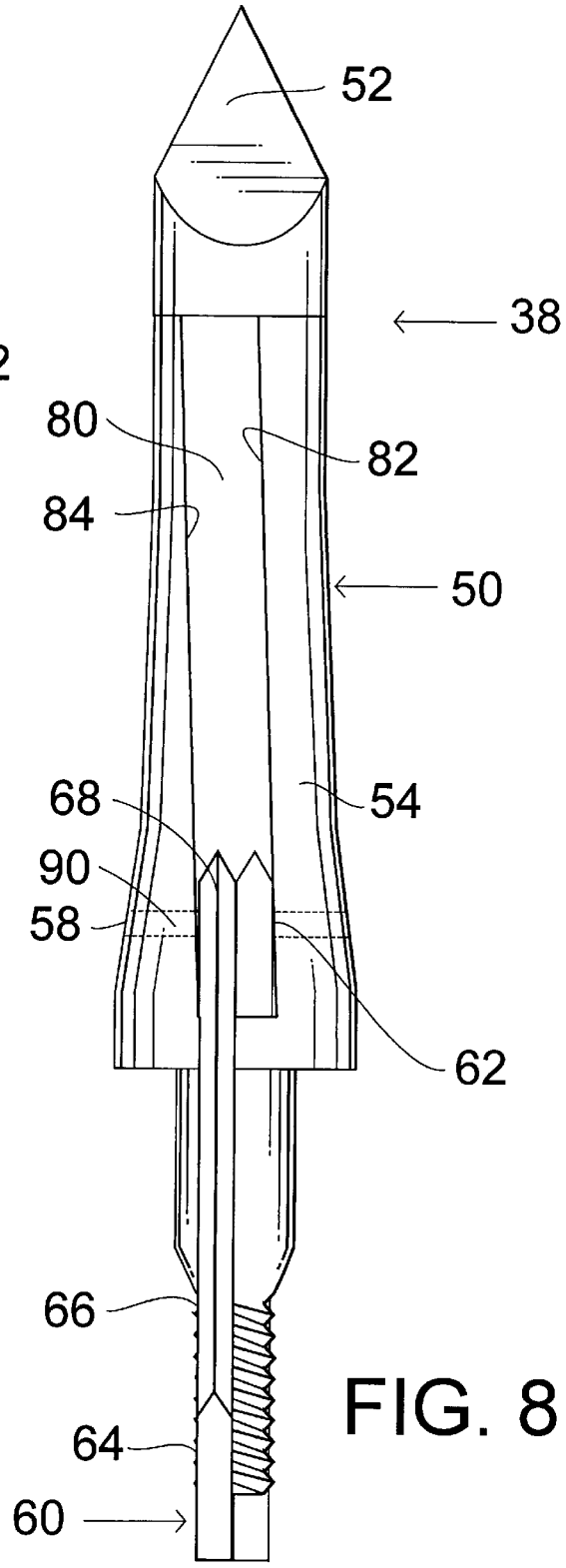
FIG. 8 is a perspective view of the preferred embodiment as illustrated in FIG. 7 showing the blades in the open position.

FIGS. 7 and 8, illustrate a blade-opening arrowhead 38, another preferred embodiment according to this invention which is similar to the preferred embodiment as illustrated in FIGS. 4–6 wherein both blades 60 rotate in planes that are not parallel to the blade slot sidewalls 82, 84 of their blade slot 80 such that each blade 60 is camed or flexed such that it remains securely held selectively in the retracted position by frictional engagement until acted upon by a sufficient opening force. According to the scope of this invention it is apparent that a pair of blades 60 in a single blade slot 80 which is exposed to opposing sides of exterior surface 54 of arrowhead body 50, wherein each blade 60 rotates in a plane not parallel to sidewalls 82, 84 of their corresponding blade slot 80, can be selectively retained in the retracted position where medial blade faces 66 of each blade 60 abut against each other.

Figure 9:
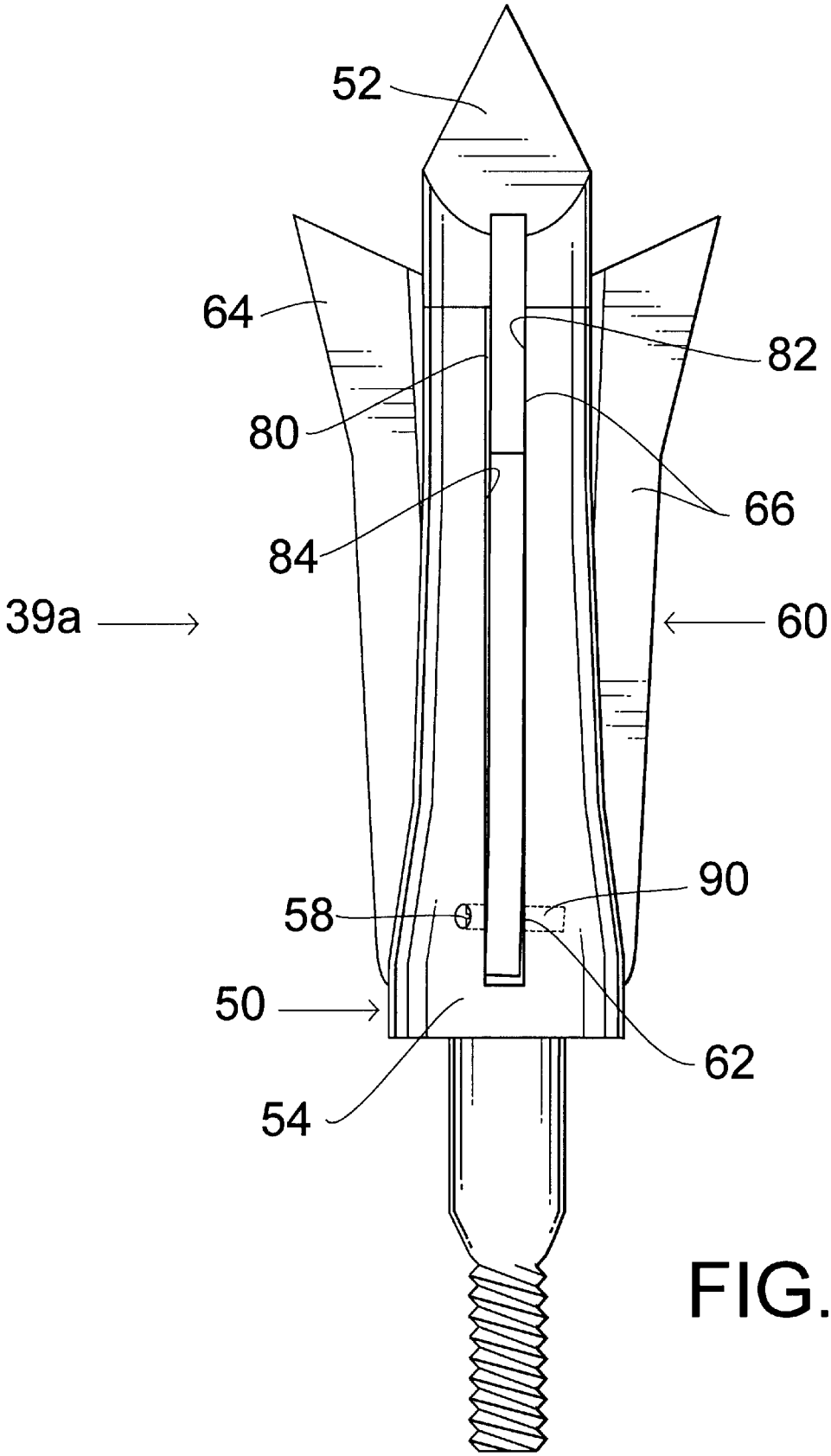
FIG. 9 is a perspective view of another preferred embodiment according to this invention similar to the preferred embodiment as illustrated in FIG. 2, but having the blade slots parallely aligned with the longitudinal axis of the arrowhead.
Figure 10:
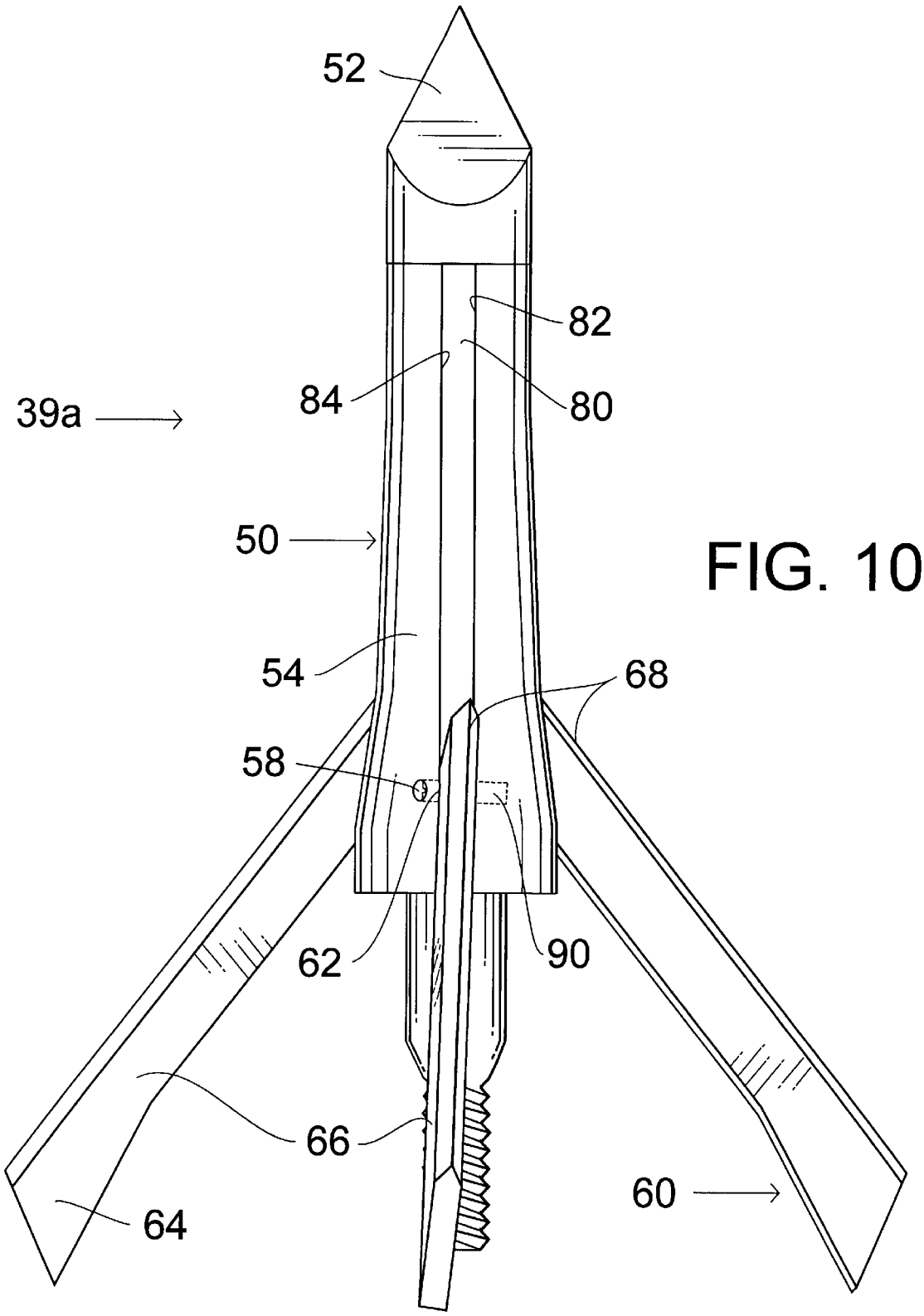
FIG. 10 is a perspective view of the preferred embodiment as illustrated in FIG. 9, showing the blades in the open position, inclined such to produce right-handed spinning.
Figure 11:
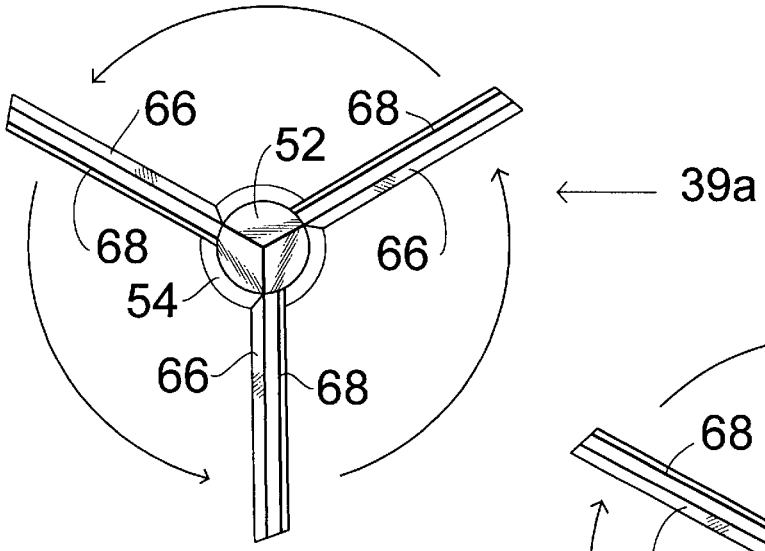
FIG. 11 is a top view of the preferred embodiment as illustrated in FIGS. 9 and 10, showing the arrowhead spinning counter-clockwise or having right-handed spinning.

FIGS. 9–11, illustrate a blade-opening arrowhead 39*a*, another preferred embodiment according to this invention which is similar to the preferred embodiment as illustrated in FIGS. 1–3, except blade slots 80 are radially aligned with the longitudinal axis of arrowhead body 50, and blades 60 when in the open position as shown in FIG. 10, are non-parallely aligned with the longitudinal axis of arrowhead body 50, or are orientated in a plane inclined or sloped relative to such axis. Particularly, blades 60 when in the open position are inclined such to induce right-handed spinning of arrowhead 39*a* when penetrating an object, wherein the arrowhead spins toward the right as viewed from the side as shown in FIG. 10. As viewed from the top as in shown in FIG. 11, arrowhead 39*a* spins counter-clockwise.

Figure 12:
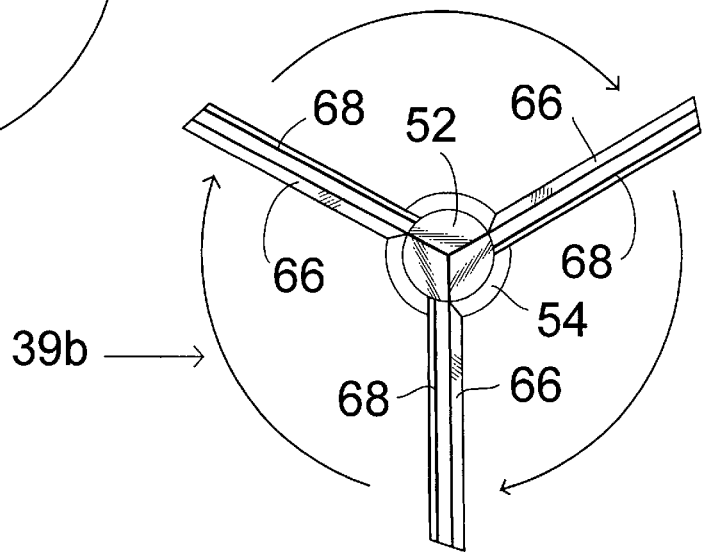
FIG. 12 is a top view of another preferred embodiment according to this invention similar to the embodiment as illustrated in FIG. 11, but showing the arrowhead spinning clockwise or having left-handed spinning.

FIG. 12 illustrates a blade-opening arrowhead 39*b* another preferred embodiment according to this invention which is similar to the preferred embodiment 39*a* as illustrated in FIGS. 9–11, except blades 60 are inclined in the open position such to induce left-handed spinning of arrowhead 39*b*, or counter-clockwise spinning as viewed from the top as in shown in FIG. 12. It is apparent that the direction of spin induced by the non-parallel inclination of blades 60 with respect to longitudinal axis 56, on arrowhead body 50 can be in the same direction arrow 100 rotates in during flight, or can be opposite the direction arrow 100 rotates in during flight.

Figure 13:
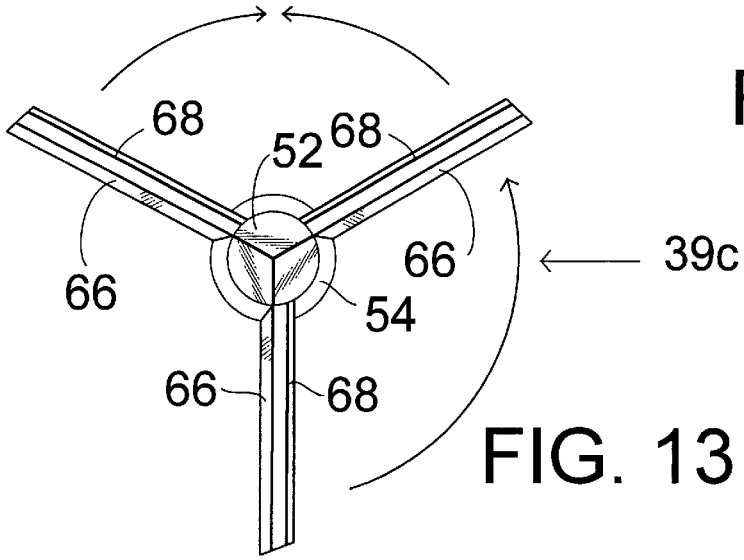
FIG. 13 is a top view of another preferred embodiment according to this invention similar to the embodiments as illustrated in FIGS. 11 and 12, but having both counter-clockwise and clockwise inclined spin inducing blades.

FIG. 13 illustrates a blade-opening arrowhead 39*c* another preferred embodiment according to this invention which is similar to the preferred embodiments 39*a* and 39*b* except arrowhead 39*c* has both left-handed spin and right-handed spin inducing inclined blades 60 when in the open position such to induce counter-clockwise and clockwise spin forces, as seen from a top view, as is shown in FIG. 13. These dual direction spin inducing forces serve to further reduce penetration by producing a braking effect where the net spin in a particular direction is greatly inhibited, thus depleting kinetic energy that could be used for furthering penetration. It is apparent that four blades 60 could be mounted to arrowhead body 50, with two blades 60 having the same spin direction inducing inclination and the other two blades 60 having opposing spin direction inducing inclination so as to have no net spin in either direction and to therefore maximize the braking effect.

Figure 14:
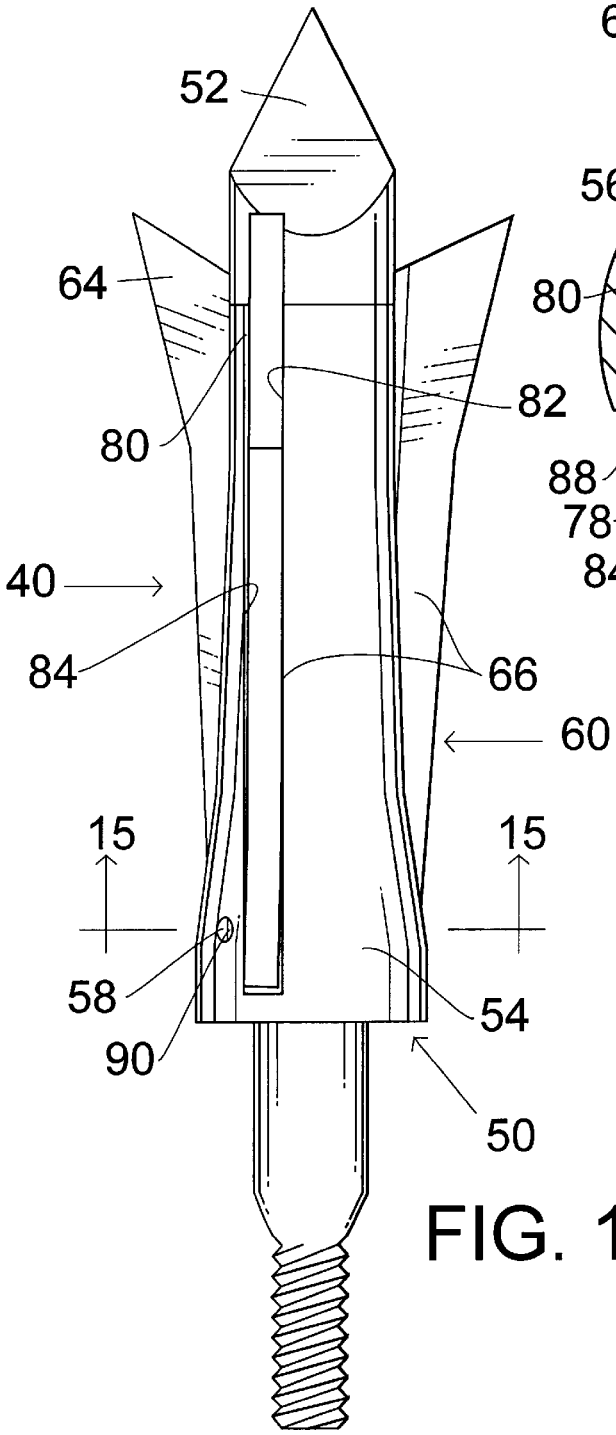
FIG. 14 is a perspective view of another preferred embodiment according to this invention similar to the preferred embodiment as illustrated in FIG. 9, but having the blades aligned non-radially such to induce pulling that produces right-handed spinning.
Figure 15:
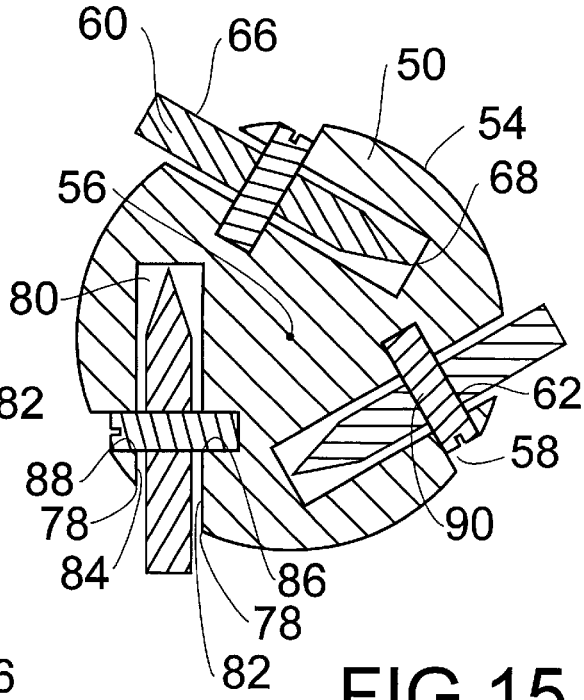
FIG. 15 is a cross-sectional view taken along line 15—15 of FIG. 14.
Figure 16:
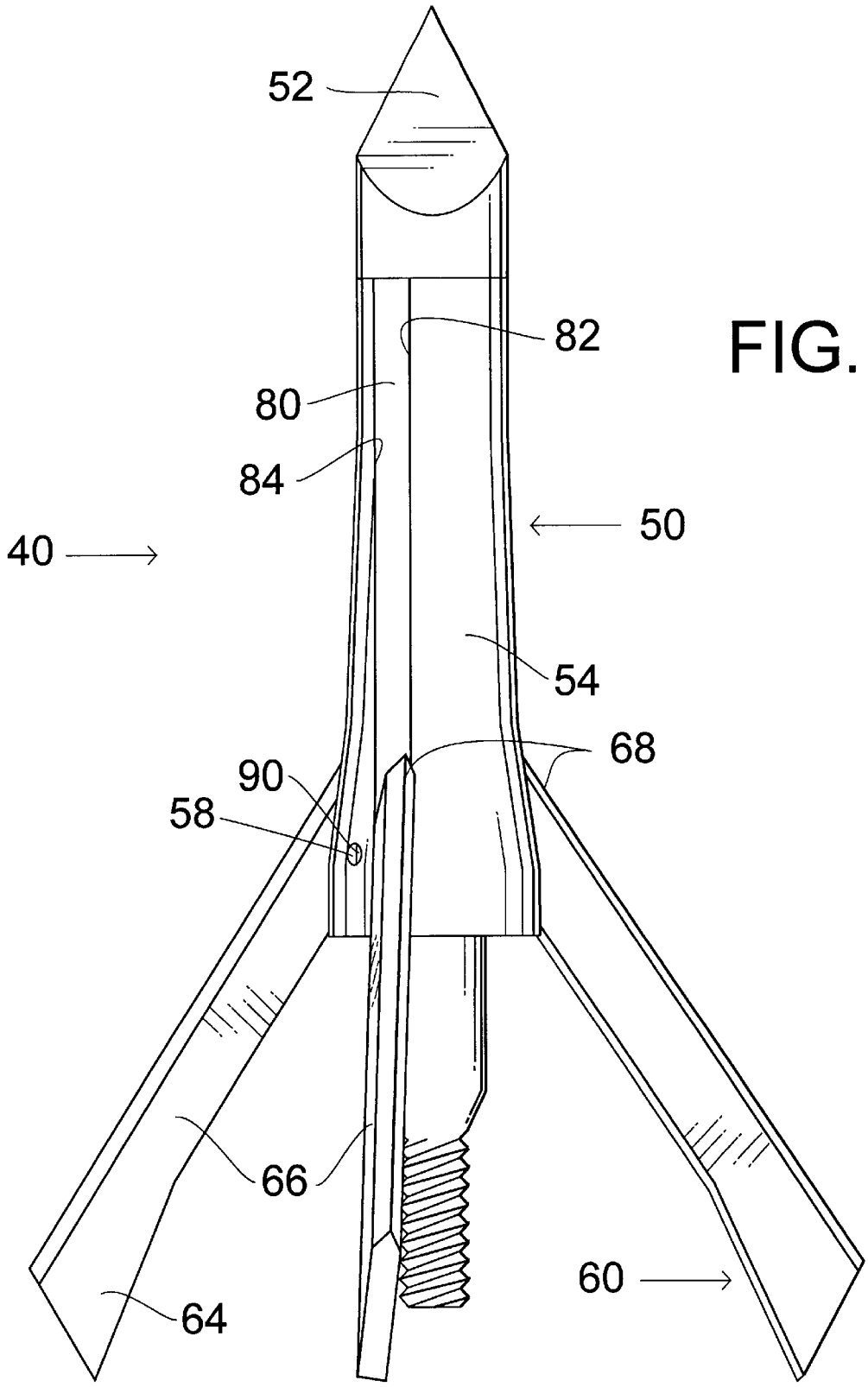
FIG. 16 is a perspective view of the preferred embodiment as illustrated in FIG. 14, showing the blades in the open position inclined such to produce right-handed spinning.

FIGS. 14–16, illustrate a blade-opening arrowhead 40 another preferred embodiment according to this invention which is similar to the preferred embodiment as illustrated in FIGS. 9–11, except arrowhead 40 has blades 60 aligned non-radially such that the pull by blades 60 on arrowhead body 50 when penetrating an object produces right-handed spinning. Non-radial blade alignment that produces right-handed spinning is shown in FIG. 15, wherein the shortest distance between an exposed exterior corner 78 on a first blade slot sidewall 82, and a first intersecting location 86 of hinge pin 90 and first sidewall 82, is longer than the shortest distance between an exposed exterior corner 78 on a second blade slot sidewall 84, and a second intersecting location 88 of hinge pin 90 and second sidewall 84. This right-handed spinning pull coupled with blades 60 being inclined non-parallely with the longitudinal axis 56 of arrowhead body 50 when in the open position such as to also produce right-handed spinning, enhances the spinning capacity of arrowhead 40.

Figure 17:
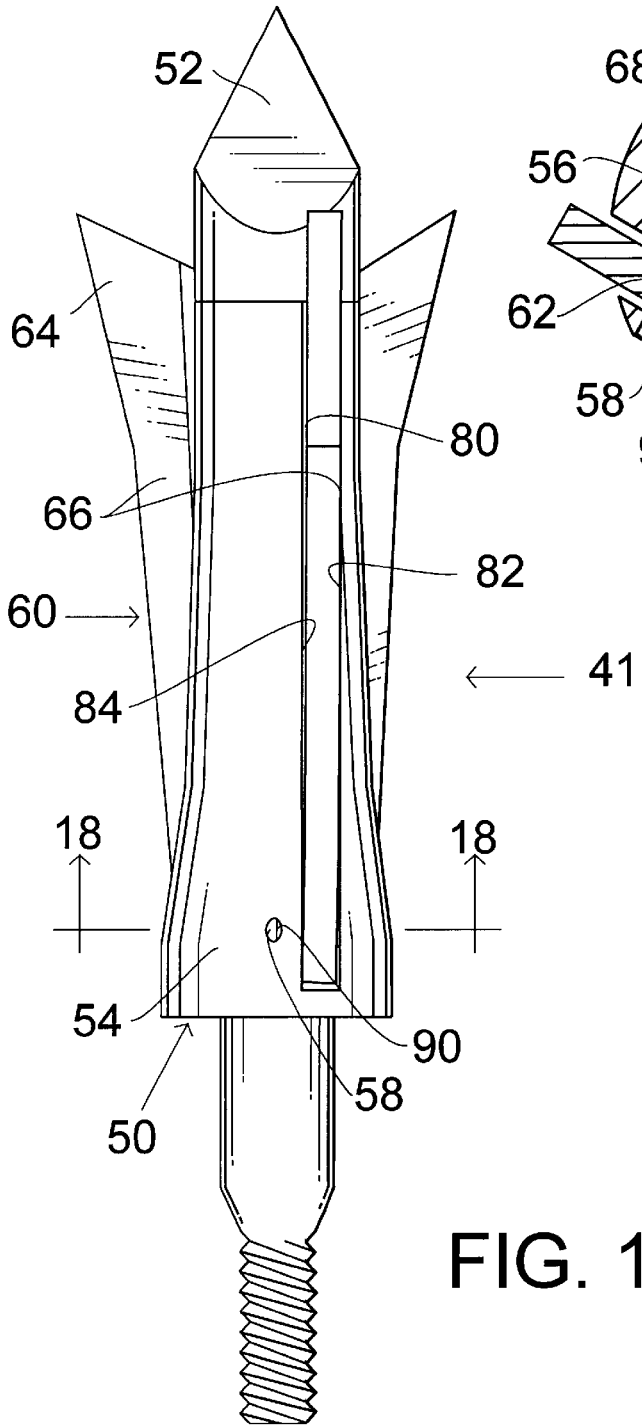
FIG. 17 is a perspective view of another preferred embodiment according to this invention similar to the preferred embodiment as illustrated in FIG. 14, but having the blades aligned non-radially such to induce pulling that produces left-handed spinning.
Figure 18:
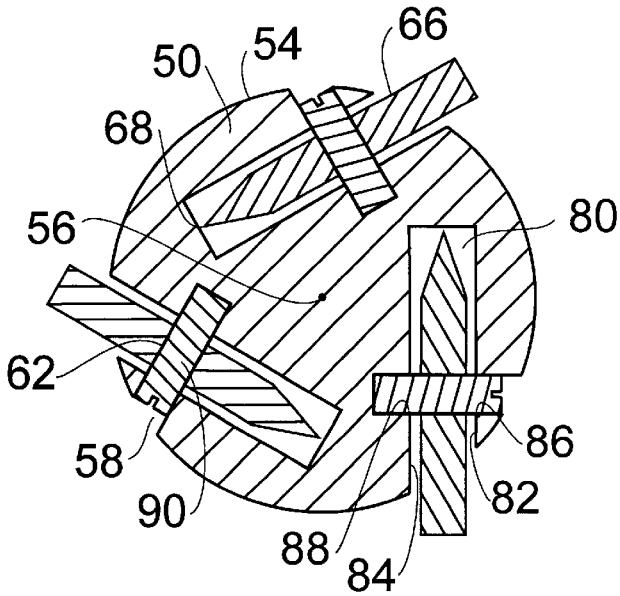
FIG. 18 is a cross-sectional view taken along line 18—18 of FIG. 17.
Figure 19:
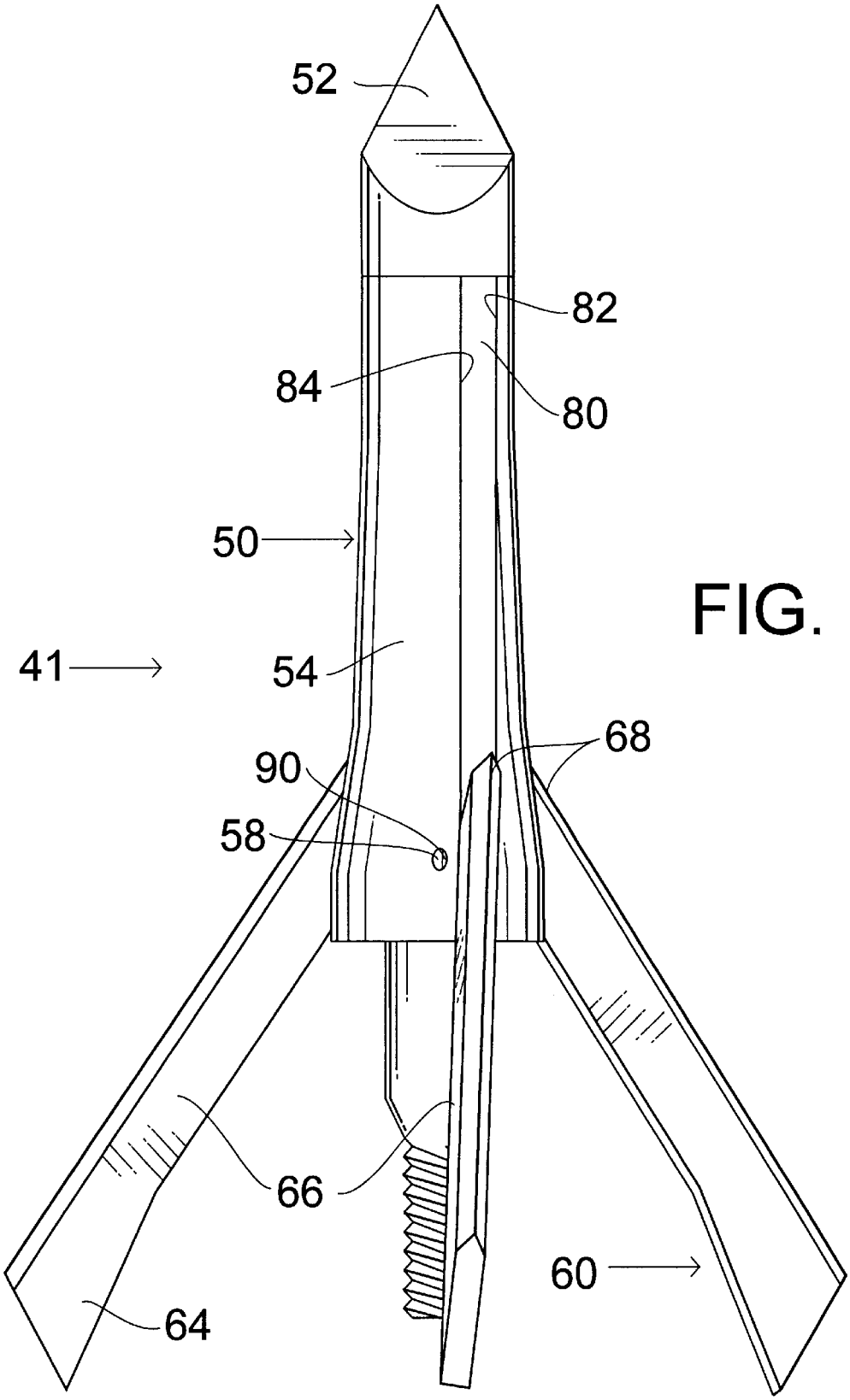
FIG. 19 is a perspective view of the preferred embodiment as illustrated in FIG. 17, showing the blades in the open position inclined such to produce right-handed spinning.

FIGS. 17–19, illustrate a blade-opening arrowhead 41 another preferred embodiment according to this invention which is similar to the preferred embodiment as illustrated in FIGS. 14–16, except arrowhead 41 has blades 60 aligned non-radially such that the pull by blades 60 on arrowhead body 50 when penetrating an object produces left-handed spinning. Non-radial blade alignment that produces left-handed spinning is shown in FIG. 18, wherein the shortest distance between longitudinal axis 56 of arrowhead body 50, and a first intersecting location 86 of hinge pin 90 and a first sidewall 82, is longer than the shortest distance between longitudinal axis 56 and a second intersecting location 88 of hinge pin 90 and a second sidewall 84. This left-handed spinning pull works against the right-handed spinning produced by inclined blades 60 and serves to also produce a braking effect which further reduces penetration.

FIGS. 20–22, illustrate another example of retention means according to this invention wherein a blade-opening arrowhead 42 according to one preferred embodiment of this invention has a blade face 66 of each blade 60 biasly engaged against an exposed exterior corner 78 formed at the juncture of a blade slot sidewall 82 and the exterior surface 54 of arrowhead body 50 when in the retracted position. Each blade slot sidewall 82 of each engaging corner 78 is sloped relative to the plane its respective blade 60 rotates in such that the leading ends of blades 60 intersect with the corners 78 when blades 60 are folded into the retracted position. When in the retracted position a rigid, non-flexible knob 72 formed on one blade face 66 of each blade 60, as shown in FIG. 22, is engaged with exposed exterior corner 78 of corresponding blade slot 80 such that knobs 72 are positioned to bias against corners 78 when blades 60 are in the retracted position, as shown in FIG. 21. This independently retains each blade 60 selectively in the retracted position by frictional engagement. As is clearly shown in FIG. 21, blade slots 80 are non-radially aligned with longitudinal axis 56, and the plane each blade 60 rotates in is radially aligned with axis 56, wherein each blade 60 is diagonally disposed within its blade slot 80 when in the retracted position so that an inside angle is formed between face 66 of each blade 60 and corresponding blade slot sidewall 82 of each blade slot 80. Accordingly, the plane that each blade 60 rotates in is not parallel to sidewalls 82, 84 of corresponding blade slots 80.

FIGS. 23–25, illustrate a blade-opening arrowhead 43 another preferred embodiment according to this invention which is similar to the preferred embodiment as illustrated in FIGS. 20–22, except arrowhead 43 has a recess 70 formed in one blade face 66 of each blade 60, as shown in FIGS. 24 and 25. Recess 70 of each blade 60 engages with exposed exterior corner 78 of each corresponding blade slot 80 such that blades 60 bias against corners 78 and recesses 70 are positioned to receive corners 78 therein when blades 60 are in the retracted position, thus independently retaining each blade 60 selectively in the retracted position by frictional engagement. As is clearly shown in FIG. 24, blade slots 80 are non-radially aligned with longitudinal axis 56, and the plane each blade 60 rotates in is radially aligned with axis 56, wherein each blade 60 is diagonally disposed within its blade slot 80 when in the retracted position so that an inside angle is formed between face 66 of each blade 60 and corresponding blade slot sidewall 82 of each blade slot 80. Accordingly, the plane that each blade 60 rotates in is not parallel to sidewalls 82, 84 of corresponding blade slots 80.

Engagement means according to this invention comprise any shape or shapes in blade 60 capable of engaging with any shape or shapes in an exposed exterior corner 78 of arrowhead body 50 such that blades 60 are securely held selectively adjacent to arrowhead body 50 or within blade slots 80 when blades 60 are in the retracted position. Engagement means may include voids, notches, cavities, protrusions, lips, or any combination thereof. The engaging surfaces of each blade 60 and corresponding corners 78 may comprise any combination of configurations of flat, convex, concave, and inclined, such as flat to flat, flat to convex, and concave to convex. For example, a rigid flat surface of blade face 66 may be biased into a pointed projection of corner 78.

It is important for an arrowhead to be light weight so as to not inhibit or reduce the velocity of the arrow. Faster arrow velocities provide flatter-shooting and therefore more accurate arrow trajectories. This is very desirable since it greatly aids in accurate shot placement. Also, it is very desirable to cut a wide wound channel, such as is possible from blade-opening arrowheads. Particularly, an optimal more lethal wound channel has more than a two blade cut path, with three or four blades being the most preferable, since the two blade designs sometimes miss cutting vital tissue that a three blade or four blade design wouldn't. Preferably to optimize lethality, it is desirable to have all blades 60 exposed at a maximum cutting diameter such as is possible with the pivotal blades of blade-opening arrowheads.

Figure 26:
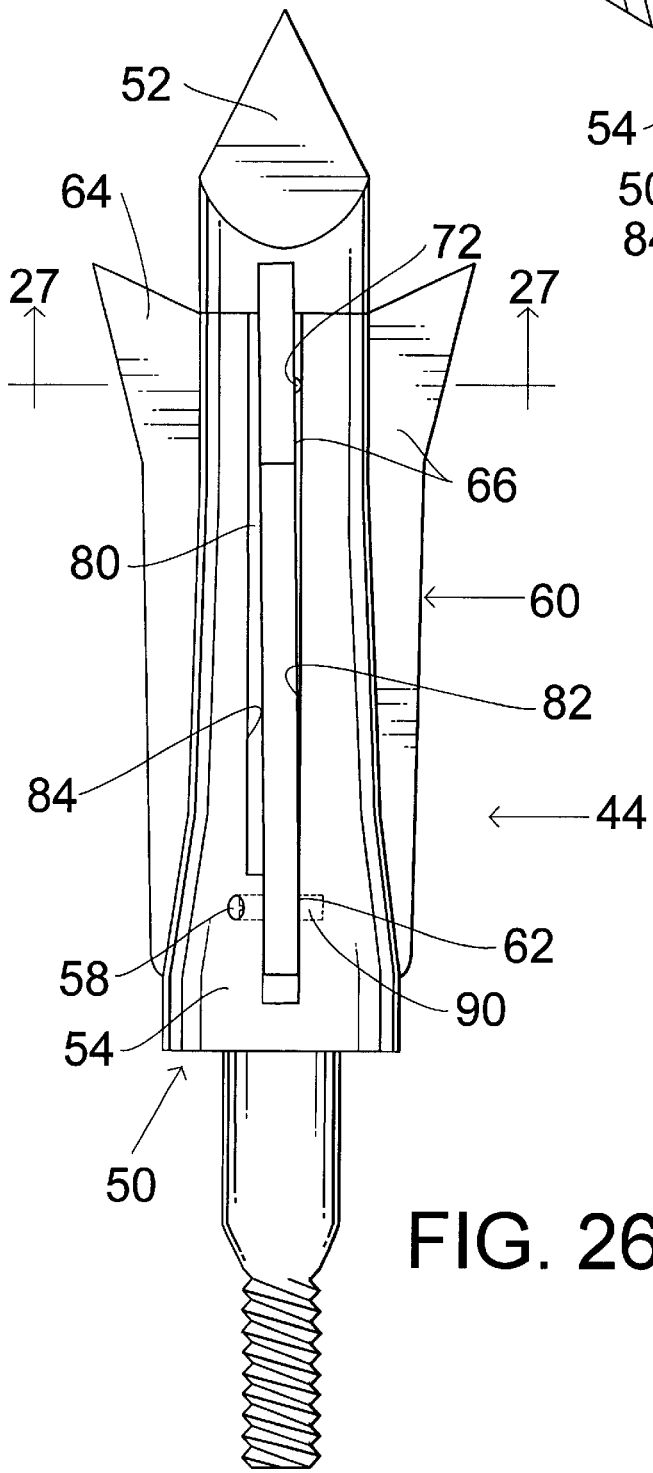
FIG. 26 is a perspective view of another preferred embodiment according to this invention where the blade slots are wider toward the forward end of the slots and each blade slot is substantially parallely aligned with the plane each corresponding blade rotates in, and where a rigid, non-flexible knob extending from each blade cams the blades in their respective blade slots.
Figure 27:
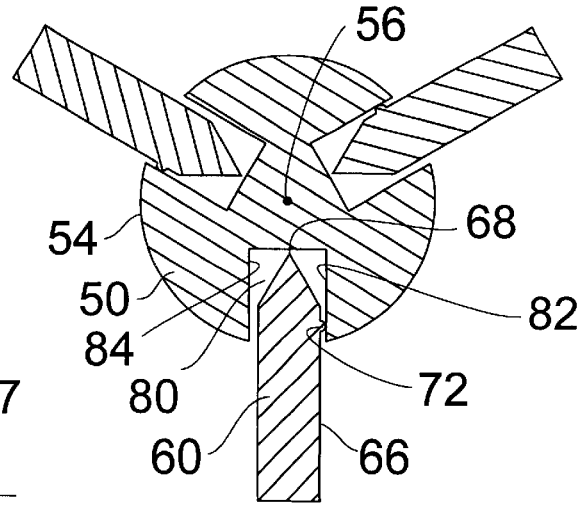
FIG. 27 is a cross-sectional view taken along line 27—27 of FIG. 26.

FIGS. 26 and 27, illustrate another example of retention means according to this invention wherein a blade-opening arrowhead 44 according to one preferred embodiment of this invention has the capability for producing the more lethal three or four blade, wide diameter, wound channels characteristic of blade-opening arrowheads, while retaining both a light weight and a strong construction. Blade-opening arrowhead 44 has three blades 60 equi-distantly displaced around the perimeter of arrowhead body 50, all within one blade slot layer. This minimizes the mass of arrowhead body 50 and therefore helps maintain a flat-shooting arrow trajectory. Particularly, blade-opening arrowhead 44 has a rigid, non-flexible knob 72 formed on and extending from one blade face 66 of each blade 60, as shown in FIG. 27. As shown in FIG. 26, the opening between sidewalls 82 and 84 of each slot 80 is wider toward the forward end or tip end of slot 80, and therefore narrower toward the rearward end of slot 80. This serves to hold the attachment ends of blades 60 with a relatively tight fit within blade slots 80 so that when each blade 60 is folded into the retracted position within its respective slot 80, each knob 72 urges against corresponding sidewall 82 of its corresponding blade slot 80 such that each blade 60 is camed or flexed sufficiently to be independently retained selectively therein by frictional engagement. Blade slots 80 and the plane each blade 60 rotates in, are radially aligned with longitudinal axis 56 of arrowhead body 50.

FIGS. 28 and 29, illustrate a blade-opening arrowhead 45 another preferred embodiment according to this invention which is similar to the preferred embodiment as illustrated in FIGS. 26 and 27, except arrowhead 45 has a recess 74 formed in blade slot sidewall 82 of each blade slot 80 which receives rigid, non-flexible knobs 72 therein when blades 60 are in the retracted position, thus independently retaining each blade 60 selectively in the retracted position by frictional engagement.

FIGS. 30 and 31, illustrate a blade-opening arrowhead 46 another preferred embodiment according to this invention which is similar to the preferred embodiment as illustrated in FIGS. 26 and 27, except arrowhead 46 has a rigid, non-flexible knob 76 formed on and extending from blade slot sidewall 82 of each blade slot 80, wherein each knob 76 urges blade face 66 of corresponding blade 60, when blades 60 are in the retracted position, thus caming or flexing blades 60 within their respective blade slots 80 and therefore independently retaining each blade 60 selectively in the retracted position by frictional engagement. It is apparent that knobs 76 can comprises integrally attached beads which are welded to sidewalls 82.

FIGS. 32 and 33, illustrate a blade-opening arrowhead 47 another preferred embodiment according to this invention which is similar to the preferred embodiment as illustrated in FIGS. 30 and 31, except arrowhead 47 has a recess 70 formed in one blade face 66 of each blade 60 which receives corresponding rigid, non-flexible knobs 76 therein when blades 60 are in the retracted position, thus independently retaining each blade 60 selectively in the retracted position by frictional engagement.

Rigid, non-flexible bias means according to this invention comprise rigid, non-flexible shapes which cause blades 60 to be flexed or camed within their blade slots 80 so that frictional engagement securely holds each blade 60 selectively in the retracted position within its slot 80 or adjacent to arrowhead body 50. The bias means can be fabricated of metal, plastics or composites, and can comprise a substantially flat blade slot sidewall, or a variety of different rigid, non-flexible shapes formed or machined into the blade slot sidewalls or blade faces. The bias means may also comprise an exposed outside corner located at the juncture of blade slot sidewall 82 and exterior surface 54 of arrowhead body 50. The bias means cause each blade to be camed or flexed such that a sufficient frictional force is generated to securely hold blades 60 retained in the retracted position when exposed to incidental forces, but yet is weak enough to be quickly and immediately overcome when penetrating an object, such that razor cutting edges 68 are timely exposed, and the penetrated object is maximumly cut.

In the preferred embodiments according to this invention rigid, non-flexible bias means are preferably not additional elements as according to independent blade retention of this invention. However, according to the desired results of the blade-opening arrowheads and the scope of this invention it is apparent that the bias means can comprise additional elements.

Figure 34:
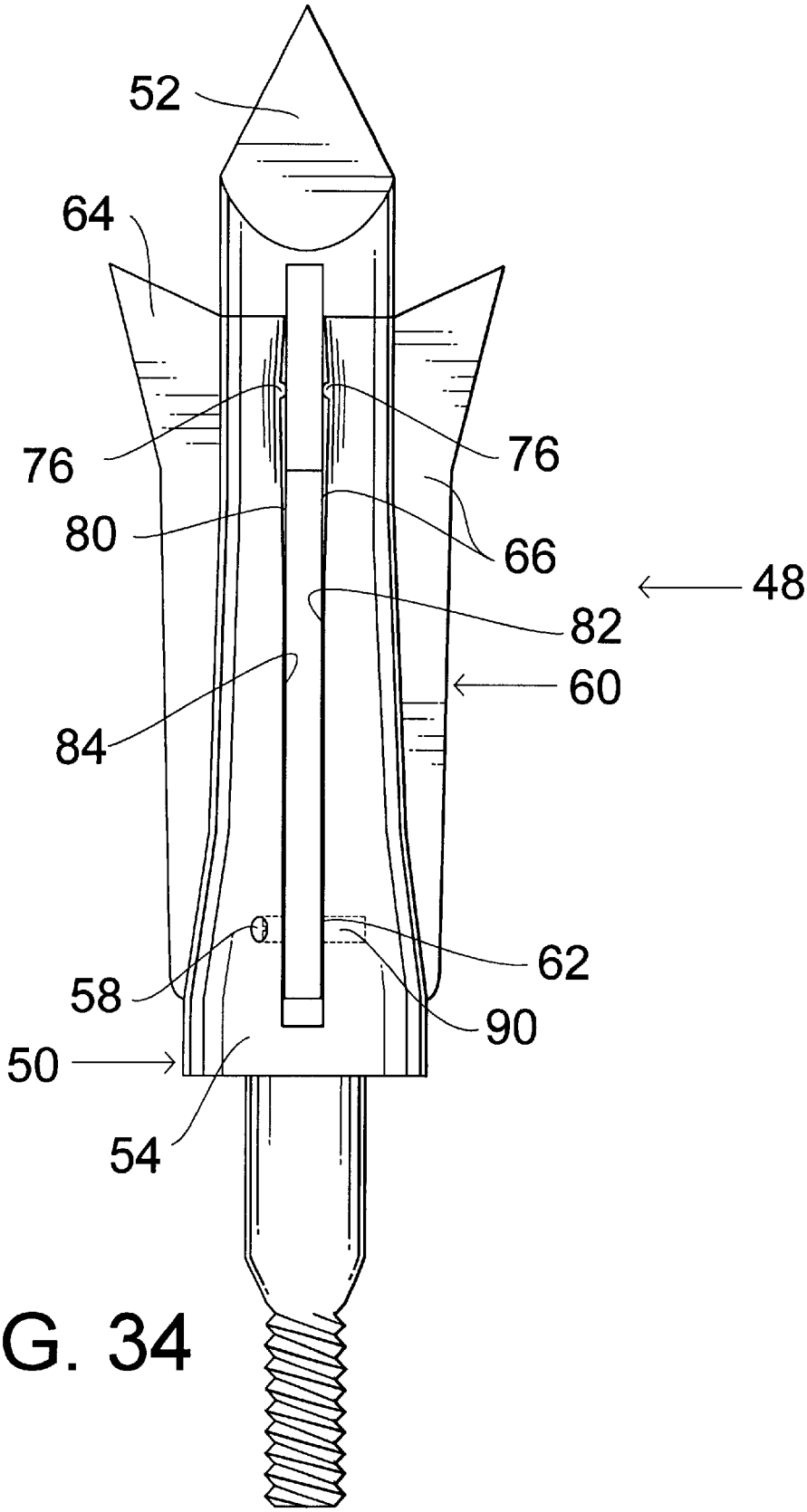
FIG. 34 is a perspective view of another preferred embodiment according to this invention having two knobs positioned opposite each other on opposing blade slot sidewalls of each blade slot, such that the slot opening width between the knobs is narrower than the thickness of a blade when the blades are not positioned in the blade slots in the retracted position, and the blade slot sidewalls are flexible. The arrowhead is shown with the blades in the retracted position where the sidewalls are flexed.

FIG. 34, illustrates yet another example of retention means according to this invention wherein a blade-opening arrowhead 48 according to one preferred embodiment of this invention has a pair of knobs 76, 76 each integrally formed in one opposing blade slot sidewall of each blade slot 80. Each knob 76 extends from its corresponding sidewall, and is positioned opposite the other knob 76 such that the opening width of each blade slot 80 between knobs 76, 76 is narrower than the thickness of blade 60 when blade 60 is not retracted therebetween. One blade 60 is situated within each blade slot 80. Arrowhead body 50 is preferably fabricated out of a resilient yet strong material, such as an injection-moldable composite resin, so as to be resilient enough or flexible enough that slot sidewalls 82 and 84 of each blade slot 80 flex when blades 60 are retracted therebetween when in the retracted position, thus independently retaining each blade 60 selectively in the retracted position by frictional engagement.

Figure 35A:
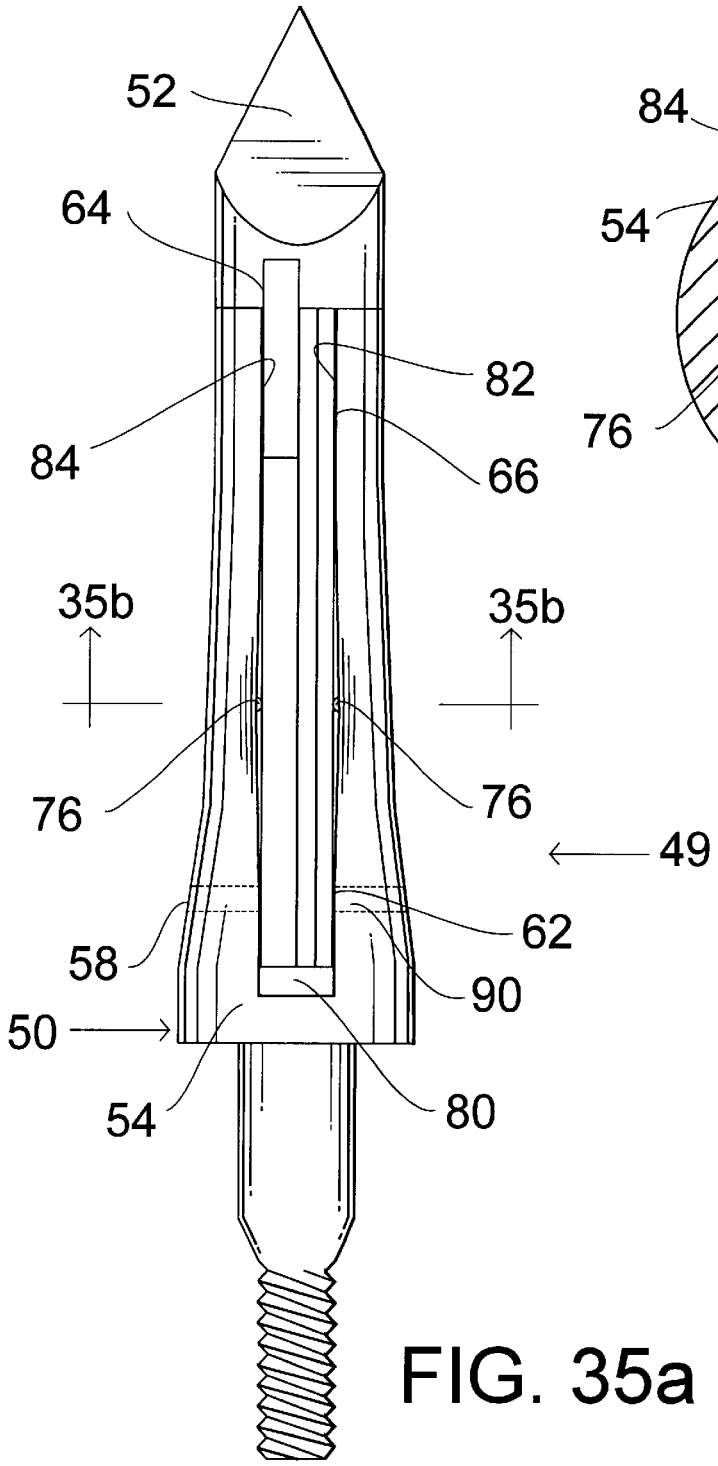
FIG. 35*a* is a perspective view of another preferred embodiment according to this invention similar to the preferred embodiment as illustrated in FIG. 34, but having two blades in a single blade slot commonly mounted to a hinge pin, where the slot opening width between the knobs is narrower than the thickness of both blades when the blades are not positioned in the blade slot in the retracted position, and the blade slot sidewalls are flexible. The arrowhead is shown with the blades in the retracted position where the sidewalls are flexed.
Figure 35B:
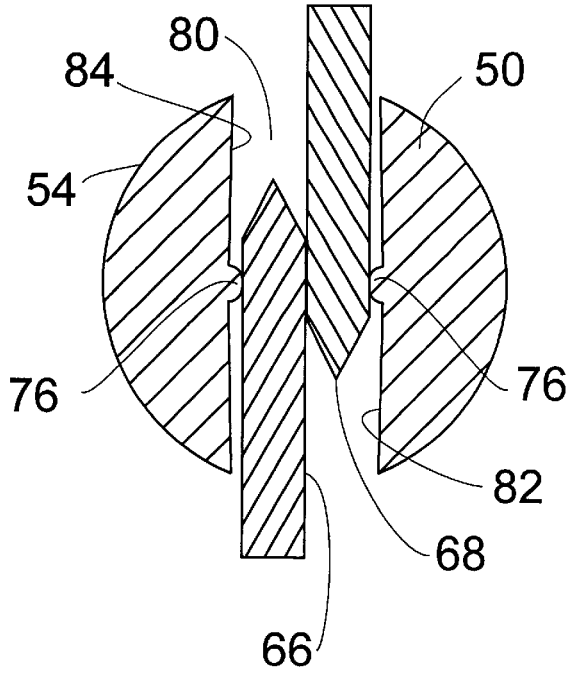
FIG. 35*b* is a cross-sectional view taken along line 35*b*—35*b* of FIG. 35*a*.

FIGS. 35*a* and 35*b* illustrate a blade-opening arrowhead 49 another preferred embodiment according to this invention which is similar to the preferred embodiment as illustrated in FIG. 34, except arrowhead 49 has two blades 60 commonly mounted on a single hinge pin 90 within a single blade slot 80 which is exposed to opposing sides of arrowhead body 50 wherein blades 60 are rotated to opposing sides of arrowhead body 50 when in the open position. Blade slot 80 has flexible sidewalls 82, 84 and the opening width therebetween for at least a portion of the length of blade slot 80 is narrower than the thickness of both blades, as determined when blades 60 are not retracted therein. Blades 60 are retained selectively in the retracted position between sidewalls 82, 84 by frictional engagement induced from flexing of sidewalls 82, 84 when blades 60 are retracted into the retracted position. The narrower opening between sidewalls 82, 84 is situated near the middle of blade slot 80, so that at impact with an animal blades 60 are quickly alleviated from the selective retaining frictional force and freely rotate to the open position. Blades 60 are quickly freed from being held in the retracted position since they only have to rotate outwards toward the open position a small distance before blade face 66 of each blade 60 is no longer in contact with corresponding knobs 76, as is clearly shown in FIG. 35*b*.

Hinge means according to this invention comprise any suitable element or elements that serve to pivotally connect each blade 60 to arrowhead body 50. Hinge means may comprise pins, rod or bar stock, bearing members such as a ball bearing, and protrusions or bumps machined or formed into the arrowhead bodies 50, and the like, and may be straight or curved such as annularly, and may accommodate, have connected thereto or have received thereon a plurality of blades 60, or a single individual blade 60. The hinge means according to this invention may attach to the arrowhead body 50 slidably, or be screwed or threaded on. It is apparent that apertures 62 may not communicate with the peripheral edges of blades 60 thereabout, thus creating a through hole, or that apertures 62 may communicate with the peripheral edges of blades 60.

Although throughout this specification the blades of the blade-opening arrowheads of the preferred embodiments are disclosed as rotating in a rearward direction away from the arrowhead body when rotating toward the open position, it is apparent that the concept, ideas and the scope of this invention are applicable to blade-opening arrowheads whose blades rotate in a forward direction away from the arrowhead body when rotating toward the open position.

According to this invention, each blade is preferably housed in a respective blade slot or equivalent, configured to receive the blade or blades. The blade slot or slots, are preferably substantially internal within the arrowhead body and defined or limited by partially bounding sidewalls, but may be substantially recessed entirely external upon the arrowhead body, such that the exterior surface of the arrowhead body is a flat partially bounding sidewall of a blade slot, or of each blade slot. In such instances it is apparent that a screw may be inserted through the aperture of each blade to serve as a hinge pin, particularly where each screw has a flat portion larger in diameter than the hinge pin portion, which serves to function as a second blade slot sidewall when screwed up next to the lateral blade face, thus preventing unwanted blade displacement relative to the arrowhead body. It is also apparent that for substantially entirely external blade slots according to this invention, a second shorter longitudinal length sidewall positioned lateral of the exterior surface sidewall may be formed by machining or fabricating, so as to function to prevent unwanted blade displacement relative to the arrowhead body and to receive a hinge pin. According to one such embodiment each blade is mounted non-parallely with respect to the longitudinal axis of the arrowhead body when in the retracted position, and each hinge pin is mounted non-perpendicularly to each blade when the blades are in the retracted position, wherein each blade is biasly engaged against the exterior surface sidewall so as to be independently retained selectively in the retracted position. Each blade aperture is elliptical in shape, having a cross-sectional area greater than the cross-sectional area of its corresponding hinge pin, such that each blade rotates in a changing plane to the open position where the blades are aligned parallely with the longitudinal axis of the arrowhead body. A changing plane is where the angle between the longitudinal axis of the arrowhead body and the plane the blade is in, changes as the blade rotates toward the open position.

The amount the blades or a particular portion of each of the blades is exposed outside the arrowhead body may vary, but will be such that the arrowheads according to this invention exhibit the excellent arrow trajectory and aerodynamics, characteristic of blade-opening arrowheads, and will have a sufficient moment-arm to lever or rotate the blades quickly and freely to the open position. It is apparent that the blade-opening arrowheads according to this invention may have any number of blades, with two, three or four being preferred. It is apparent that the blade-opening arrowheads according to this invention may have non-pivotal or fixed blades attached to an arrowhead body in combination with the pivotal blades. It is apparent that the different and various elements of this invention may be made of light weight and strong materials, such as various different plastic or graphite composites, aluminum alloys, titanium alloys, stainless steels and other metals and materials. It is apparent that the tip end of each arrowhead body according to this invention, may be removably attachable to the arrowhead body, such as to a substantially frustuconical arrowhead body, or that it may be integral with such arrowhead body. It is also apparent that the arrowhead bodies of the blade-opening arrowheads according to this invention may be fastened to the forward end of an arrow shaft by any method, such as threading into an insert, or glueing.

The user-friendly and durable nature of the blade retention methods according to this invention provide blade-opening arrowheads that are, easy to use, failsafe and worry-free. While the arrowheads are exposed to hard use and harsh conditions in the field, the user will appreciate the simplicity and ease involved in their use. The non-consumable nature of the blade retention methods of the present invention allows the archer to simply push the blades back towards the retracted position to securely re-lock the blades in the retracted position, thus quickly and easily readying the arrowhead for repeated use. When compared to prior art blade-opening arrowheads the blade-opening arrowheads of the present invention require less parts or elements for blade retention, which makes them more cost effective, simpler to manufacture, and less susceptible to failure.

Blade-opening arrowheads according to this invention are capable of preventing complete arrow pass-through in wild turkeys and other small game animals when using powerful, accurate, flat-shooting bows, by providing increased spinning capacity. The reduced penetration from such increased spinning improves the recovery rate of such arrowed game animals. Blade-opening arrowheads according to this invention are also capable of providing a more traumatized and tissue damaged wound channel than prior art blade-opening arrowheads, due to the increased spinning capacity.

It is apparent that different forms of retention means according to this invention may exist which have not been discussed above. It is apparent that different bias means, engagement means, hinge means and other elements and their equivalents, as discussed above and according to other preferred embodiments of this invention, can be changed, or interchanged, or eliminated, or duplicated, or made of different materials, and connected to or associated with adjacent elements in different manners, other than suggested herein, without deterring from the desired results of the blade-opening arrowheads according to this invention. For example, a single knob, integrally formed in one sidewall of a resilient or flexible arrowhead body can be positioned such to independently retain a single blade in the retracted position by frictional engagement according to this invention, wherein the knob and/or blade slot sidewall is flexed, or where the blade is camed and the knob and/or sidewall is flexed. As another example, additional elements such as two flexible knobs or protrusions can be attached to opposing blade slot sidewalls of an arrowhead body fabricated from substantially non-resilient material such as aluminum, wherein the opening between the knobs is narrower the thickness of the corresponding blade when the blade is not retracted therebetween, such that when the blade is retracted therebetween the knobs flex and a sufficient frictional force is generated between the knobs and the substantially flat blade face to selectively retain the blade in the retracted position until penetrating an animal. As yet another example, a sleeve made of, but not limited to flexible or resilient material, can be securely inserted into a larger width longitudinal groove in a separately formed arrowhead body made of aluminum, wherein the opening width between sidewalls of the larger width groove is narrower at the exterior surface of the arrowhead body so that when the sleeve is inserted therein the sleeve remains securely attached to the arrowhead body and therefore acts or functions as a pair of blade slot sidewalls such to produce blade-opening arrowheads with similar results of the blade-opening arrowheads according to this invention.

It is to be understood that the present invention is not limited to the sole embodiments described above, as will be apparent to those skilled in the art, but encompasses the essence of all embodiments, and their legal equivalents, within the scope of the following claims.

I claim:

1. A blade-opening arrowhead comprising:

(a) an arrowhead body;

(b) a blade having a first end, an opposing second end, and a pair of planar faces extending from said first end to said second end on Opposing sides of said blade;

(c) a blade receiving slot substantially longitudinally recessed within said arrowhead body, said receiving slot being partially bounded by a sidewall;

(d) hinge means for pivotally connecting said second end of said blade to said arrowhead body to enable said blade to rotate between a retracted position wherein said blade is positioned adjacent to said arrowhead body and an open position wherein said first end of said blade is rotated away from said arrowhead body; and (e) means for independently retaining said blade selectively in said retracted position so that said blade is independently securely held adjacent to said arrowhead body when in said retracted position and said blade freely rotates into said open position when the arrowhead penetrates an object, said means for retaining consisting essentially of said blade, said blade receiving slot and said hinge means.

2. A blade-opening arrowhead as recited in claim 1, wherein said blade comprises a wing outwardly projecting from said first end thereof.

3. A blade-opening arrowhead as recited in claim 1, wherein said blade comprises an inner sharpened cutting edge extending at least in part between said first end and said second end of said blade, said inner sharpened cutting edge when said blade is in said retracted position facing toward said arrowhead body.

4. A blade-opening arrowhead as recited in claim 1, wherein when said blade rotates from said retracted position to said open position, said blade rotates through and angle greater than 90 degrees.

5. A blade-opening arrowhead as recited in claim 1, where in at least one of said blade side faces has an indent or a bump formed thereon.

6. A blade-opening arrowhead as recited in claim 1, wherein at least one of said blade side faces has a through hole or a cut formed thereon, said through hole or cut being disposed closer to said first end of said blade than to said second end of said blade.

7. A blade-opening arrowhead as recited in claim 1, wherein said arrowhead body further comprises a central longitudinal axis, said blade rotating in a plane that is spaced apart from said central longitudinal axis when rotating from said retracted position to said open position.

8. A blade-opening arrowhead as recited in claim 1, wherein said arrowhead body comprises an exposed exterior surface, said sidewall of said blade receiving slot adjoining said exterior surface at an outside corner.

9. A blade-opening arrowhead as recited in claim 8, wherein at least one of said blade faces engages with said outside corner when said blade is in said retracted position.

10. A blade-opening arrowhead as recited in claim 8, wherein at least one of said blade faces has an indent or a bump.

11. A blade-opening arrowhead comprising:

(a) an arrowhead body;

(b) a substantially linear void recessed into said arrowhead body;

(c) a blade receiving slot substantially longitudinally recessed within said arrowhead body, said receiving slot being partially bounded by a sidewall;

(d) a substantially linear hinge pin mounted to said arrowhead body, said hinge pin being disposed at least in part within said void and communicating with said sidewall, said hinge pin being oriented non-perpendicular to said sidewall of said receiving slot; and (e) a blade having a free first end and an opposing second end with an aperture extending therethrough, said aperture having said hinge pin extending therethrough to enable said blade to rotate between:

(i) a retracted position wherein said blade is positioned adjacent to said arrowhead body; and (ii) an open position wherein said first end of said blade is rotated away from said arrowhead body.

12. A blade-opening arrowhead as recited in claim 11, wherein at least one of said blade side faces has an indent or a bump formed thereon.

13. A blade-opening arrowhead as recited in claim 11, wherein said arrowhead body comprises an exposed exterior surface, said sidewall of said blade receiving slot adjoining said exterior surface at an outside corner.

14. A blade-opening arrowhead as recited in claim 13, wherein at least one of said blade faces engages with said outside corner when said blade is in said retracted position.

15. A blade-opening arrowhead comprising:

(a) an elongated arrowhead body having a longitudinal axis;

(b) a blade receiving slot substantially longitudinally recessed within said arrowhead body, said receiving slot being partially bounded by a pair of opposing sidewalls; and (c) a blade having a first end, an opposing second end, and a pair of planar faces extending from said first end to said second end on opposing sides of said blade, said second end of said blade being hingedly connected to said arrowhead body to enable said blade to rotate in a plane between a retracted position wherein said blade is positioned at least in part within said slot and an open position wherein said first end of said blade is rotated away from said arrowhead body, at least one of said planar faces of said blade when said blade is in said retracted position biasly engaging against at least a portion of at least one of said sidewalls, thereby securely holding said blade by frictional engagement selectively within said receiving slot, the arrowhead when in said retracted position being configured such so as to have no structural entity or entities disposed between a section of a blade face and a section of a slot sidewall as determined in directions outward from the blade faces.

16. A blade-opening arrowhead as recited in claim 15, wherein said blade comprises a wing outwardly projecting from said first end thereof.

17. A blade-opening arrowhead as recited in claim 15, wherein said blade comprises an inner sharpened cutting edge extending at least in part between said first end and said second end of said blade, said inner sharpened cutting edge when said blade is in said retracted position facing toward said arrowhead body.

18. A blade-opening arrowhead as recited in claim 15, wherein when said blade rotates from said retracted position to said open position, said blade rotates through and angle greater than 90 degrees.

19. A blade-opening arrowhead as recited in claim 15, wherein at least one of said blade side faces has an indent or a bump formed thereon.

20. A blade-opening arrowhead as recited in claim 15, wherein at least one of said blade side faces has a through hole or a cut formed thereon, said through hole or cut being disposed closer to said first end of said blade than to said second end of said blade.

21. A blade-opening arrowhead as recited in claim 15, wherein said plane said blade rotates in when rotating from said retracted position to said open position is not parallel to at least one of said slot sidewalls.

22. A blade-opening arrowhead as recited in claim 15, wherein said arrowhead body comprises an exposed exterior surface, said sidewall of said blade receiving slot adjoining said exterior surface at an outside corner.

23. A blade-opening arrowhead as recited in claim 22, wherein at least one of said blade faces engages with said outside corner when said blade is in said retracted position.

24. A blade-opening arrowhead as recited in claim 22, wherein at least one of said blade faces has an indent or a bump.

25. An arrowhead as recited in claim 15 wherein said blade does not have a protrusion extending out from a side face thereof.

26. An arrowhead as recited in claim 15 wherein said blade slot sidewalls are entirely substantially planar.

27. A blade-opening arrowhead comprising:

(a) an arrowhead body;

(b) a blade having a first end, and an opposing second end;

(c) a blade receiving slot substantially longitudinally recessed within said arrowhead body, said receiving slot being partially bounded by a sidewall, wherein said receiving slot comprises a pair of opposing sidewalls with an opening extending therebetween, said opening for at least a portion of said receiving slot being narrower than the thickness of said blade when said blade is not retracted therebetween, said sidewalls of said receiving slot being resilient;

(d) hinge means for pivotally connecting said second end of said blade to said arrowhead body to enable said blade to rotate between a retracted position wherein said blade is positioned adjacent to said arrowhead body and an open position wherein said first end of said blade is rotated away from said arrowhead body; and (e) retention means for independently retaining said blade selectively in said retracted position so that said blade is independently securely held adjacent to said arrowhead body when in said retracted position and said blade freely rotates into said open position when the arrowhead penetrates an object.

* * * * *